United States Patent [19]

Phillips et al.

[11] Patent Number: 4,829,761

[45] Date of Patent: May 16, 1989

[54] CONTINUOUS FILAMENT YARN HAVING SPUN-LIKE OR STAPLE-LIKE CHARACTER

[75] Inventors: Bobby M. Phillips; James O. Casey, both of Kingsport, Tenn.

[73] Assignee: Eastman Kodak Company, Rochester, N.Y.

[21] Appl. No.: 58,959

[22] Filed: Jun. 5, 1987

[51] Int. Cl.[4] ..... D02G 3/22

[52] U.S. Cl. ..... 57/248; 57/243; 57/244

[58] Field of Search ..... 57/248, 244, 907, 908, 57/243

[56] References Cited

U.S. PATENT DOCUMENTS

| | | | |
|---|---|---|---|
| 2,783,609 | 3/1957 | Breen | 57/140 |
| 2,901,466 | 8/1959 | Kibler et al. | 260/75 |
| 2,924,868 | 2/1960 | Dyer | 28/1 |
| 3,219,739 | 11/1965 | Breen et al. | 264/177 |
| 3,242,035 | 3/1966 | White | 161/168 |
| 3,470,594 | 10/1969 | Kim | 28/72 |
| 3,712,743 | 1/1973 | Harris et al. | 356/289 |
| 3,857,232 | 12/1974 | Heinrich et al. | 57/157 R |
| 3,857,233 | 12/1974 | Cardinal et al. | 57/157 R |
| 3,946,548 | 3/1976 | Hino et al. | 57/140 J |
| 3,962,189 | 6/1976 | Russin et al. | 260/75 R |
| 4,095,319 | 6/1978 | Nelson | 28/273 |
| 4,235,574 | 11/1980 | Phillips | 425/72 S |
| 4,245,001 | 1/1981 | Phillips et al. | 57/248 X |
| 4,332,761 | 6/1982 | Phillips et al. | 264/147 |

*Primary Examiner*—Donald Watkins

*Attorney, Agent, or Firm*—John F. Stevens; William P. Heath, Jr.

[57] ABSTRACT

Continuous filament yarn having nonload-bearing fracturable filaments and load-bearing non-fracturable filaments, an elongation-to-break of equal to or less than 180%; yarn made from such continuous filament yarn and fractured to have spun-like or staple-like character with the nonload-bearing filaments being variably broken and having free ends either entangled with and/or projecting from the yarn bundle; fabric made from the fractured continuous yarn; and process for fracturing the continuous filament yarn.

21 Claims, 30 Drawing Sheets

200 X

PRIOR ART

100 X

100 X

1 = 6 mils

1 = 6 mils

20 X

44 X

500 X

284

50 X

200 X

100 X

CONTINUOUS FILAMENT YARN HAVING SPUN-LIKE OR STAPLE-LIKE CHARACTER

DESCRIPTION

1. Field of the Invention

Our invention relates to a continuous filament yarn comprised of a bundle of nonload-bearing fracturable filaments and load-bearing nonfracturable filaments which are essentially compatible in drafting, and to a yarn made from such continuous filament yarn and fractured to have spun-like or staple-like character with the nonload-bearing filaments being variably broken and having free ends either entangled and/or projecting from the yarn bundle.

2. Background of the Invention

Historically fibers used by man to manufacture textiles, with the exception of silk, were of short length. Vegetable fibers such as cotton, animal fibers such as wool, and bast fibers such as flax all had to be spun into yarns to be of value in producing fabrics. The very property of short staple length of these fibers requiring that the yarns made therefrom be spun yarns, also, however, resulted in bulky yarns having very good covering power, good insulating properties and a good, pleasing hand.

The operations involved in spinning yarns from staple fibers are rather extensive and thus are quite costly. For example, the fibers must be carded and formed into slivers and then subsequently be drawn to reduce the diameter and finally spun into yarn.

Many previous efforts have been made to produce spun-like yarns from continuous length filament yarns, or, as they are known in the industry, "continuous filaments". For example U.S. Pat. No. 2,783,609 discloses a bulky continuous filament yarn which is described as individual filaments individually convoluted into coils, loops and whorls at random intervals along their lengths, and characterized by the presence of a multitude of ring-like loops irregularly spaced along the yarn surface. U.S. Pat. No. 3,219,739 discloses a process for preparing synthetic fibers having a convoluted structure which imparts high bulk to yarns composed of such fibers. The fibers or filaments will have 20 or more complete convolutions per inch, but it is preferred that they have at least 100 complete convolutions per inch. Yarns made from these convoluted filaments do not have free protruding ends like spun or staple yarns and are thus deficient in textile aesthetics.

Other multifilament yarns which are bulky and have spun-like character include yarns such as that shown in U.S. Pat. No. 3,946,548 wherein the yarn is composed of two portions, i.e. a relatively dense portion and a blooming, relatively sparse portion, alternately occurring along the length of the yarn. The relatively dense portion is in a particularly twisted state and individual filaments in this portion are irregularly entangled and cohere to a greater extent than in the relatively sparse portion. The relatively dense portion has protruding filament ends on the yarn surface in a larger number than the relatively sparse portion. The protruding filaments are formed by subjecting the yarn to a high velocity fluid jet to form loops and arches on the yarn surface, false twisting the yarn bundle and then passing the yarn over a friction member, thereby cutting at least some of the looped and arched filaments on the yarn surface to form filament ends.

Yarns such as the texturized yarns disclosed in U.S. Pat. No. 2,783,609 and bulky multifilament yarns disclosed in U.S. Pat. No. 3,946,548 have their own distinctive characteristics but do not achieve the hand and appearance of the yarns made in accordance with our invention.

Many attempts have been made to produce bulky yarns having the aesthetic qualities and covering power of spun staple yarns without the necessity of extruding continuous filaments or formation of staple fibers as an intermediate step. For example U.S. Pat. No. 3,242,035 discloses a product made from a fibrillated film. The product described is a multifibrous yarn which is made up of a continuous network of fibrils which are of irregular length and have a trapezoidal cross-section wherein their dimension is essentially the thickness of the original film strip. The fibrils are interconnected at random points to form a cohesively unitary or onepiece network structure, there being essentially very few separate and distinct fibrils existing in the yarn due to forces of adhesion or entanglement.

In U.S. Pat. No. 3,470,594 there is disclosed another method of making a yarn which has a spun-like appearance. Here a strip or ribbon of striated film is highly oriented uniaxially in the longitudinal direction and is split into a plurality of individual filaments by a jet of air or fluid impinging upon the strip in a direction substantially normal to the ribbon. The final product is described as a yarn in which individual continuous filaments formed from the striation are very uniform in cross-section lengthwise of the filaments. At the same time there is formed from a web a plurality of fibrils having a reduced cross-section relative to the cross-section of the filament. FIGS. 8 and 9 of U.S. Pat. No. 3,470,594 show the actual appearance of yarns made in accordance with the disclosure.

The fibrillated film yarns of the prior art, which are generally characterized by the two disclosures identified above, have not been found to be useful in a commercial sense as a replacement or substitute for spun yarns made of staple fibers. These fibrillated film type yarns do not possess the necessary hand, the necessary strength, yarn uniformity, dye uniformity or aesthetic structure to be used as an acceptable replacement or substitute for spun yarns for producing knitted and woven apparel fabrics.

Yarns of the type disclosed in U.S. Pat. Nos. 3,857,232 and 3,857,233 are bulky yarns with free protruding ends and are produced by joining two types of filaments together in the yarn bundle. Usually one type filament is a strong filament with the other type filament being a weak filament. One unique feature of the yarns is that the weak filaments are broken in the false twist part of a draw texturing process. The relatively weak filaments which are broken are substantially entangled with the main yarn bundle via an air jet. Even though these yarns are bulky like staple yarns and have free protruding ends like spun yarns, fabrics produced from these yarns have aesthetics which are only slightly different from fabrics made from false twist textured yarns.

U.S. Pat. No. 4,245,001 discloses a continuous filament yarn having a spun yarn character. The yarn comprises a bundle of continous filaments with the filaments having a continuous body section with at least one wing member extending from and along the body section. The wing member is intermittently separated from the body section, and a fraction of the separated wing members extends from the body section to provide the spun yarn character of the continuous filament yarn. The yarn is further characterized in that portions of the wing member are separated from the body section to form bridge loops, the wing member portion of the bridge loop being attached at each end thereof to the body section. The wing member portion of the bridge loop is shorter in length than the corresponding body section portion. The free protruding ends that extend from the filaments have a mean separation distance along a filament of about one to about ten millimeters and have a mean length of about one to about ten millimeters. The free protruding ends are randomly distributed along the filaments. U.S. Pat. No. 4,332,761 is related to U.S. Pat. No. 4,245,001 and discloses a process for draw-fracturing textile yarn such as disclosed in U.S. Pat. No. 4,245,001. The present invention differs from these disclosures in a number of respects. For instance, there are no wing members or bridge loops. Also there are two filament components in the yarn bundle and only one of them fractures to provide free protruding ends while the other one serves a load-bearing function.

DISCLOSURE OF THE INVENTION

A. Prologue

The concept of the present invention involves the combination in a yarn of a filament component which is fractured in a high-speed jet of air to provide protruding ends and a filament component which is relatively undisturbed by the same jet of air. Although it would be highly desirable if the fracturable filament component could be utilized by itself, the strength of the fracturable filament component, when fractured enough to provide desirable aesthetics, is not sufficient without additional twist to provide a good textile yarn. In addition to the breaking of the fracturable filament component, an appropriate amount of entangling and tying down of the free ends within the total yarn bundle must also take place.

The filaments and yarns of this invention are preferably made from polyester or copolyester polymer. Polymers that are particularly useful are poly(ethylene terephthalate) and poly(1,4-cyclohexylenedimethylene terephthalate). These polymers may be modified so as to be basic dyeable, light dyeable or deep dyeable, as is known in the art. These polymers may be produced as disclosed in U.S. Pat. Nos. 3,962,189 and 2,901,466 and by conventional procedures well known in the art of producing fiber-forming processes. Also the filaments and yarns can be made from polymers such as poly(butylene terephthalate), polypropylene, or nylon such as nylon 6 and 66.

Spinning, drafting and stabilizing conditions for the yarns disclosed herein are well known and conventional in the art. See, for example, the conditions shown in Example 1 of U.S. Pat. No. 4,245,001, of which we are coinventors and which is incorporated herein by reference.

Spinning, drafting, and stabilization procedures for such yarn as described herein are well known and conventional in the art. Manufacturers and those persons with ordinary skill in the art know how to achieve any elongation to break and any boiling water shrinkage they desire. The literature is replete with descriptions, for example, with respect to polyethylene terephthalate yarn. For instance in the book *Polyester Fibres, Chemistry and Technology* by Hermann Ludewig, Wiley-Interscience, division of John Wiley & Sons Ltd., copyright 1964 (English translation was copyrighted 1971), the first page of Chapter 7 begins a discussion of "Setting of Drawn Polyester Filaments"; and the page following it shows in FIG. 7.1 a curve labeled "Dependence of boiling shrinkage on draw ratio and type of drawing procedure." Pages 251, 252, and 253 discuss and illustrate typical equipment for drawing and hot drawing yarn. Pages 247 and 248 discuss and show a curve relative to draw ratio and elongation to break.

Another book, *The Setting of Fibres and Fabrics*, copyright 1971 by Merrow Publishing Co. Ltd. (England), offers a detailed study of different fibers, including polyesters, cellulosic fibers, wool, polyamides, etc., their structure, their "setting" (meaning thermal stabilization), drafting, etc.

Still another book, *Man-Made Fibers Science and Technology*, Vol. 1, Interscience Publishers, copyright 1967 by John Wiley & Sons, Inc. goes into extensive detail on the treatment of fibers.

The making of yarns described herein from these latter polymers is more difficult, however, than from the polyester polymers mentioned above. We believe this is attributable to the increased difficulty in making these polymers behave in a brittle manner during the fracturing process in the high-speed jet of air. It could be accomplished if one wanted to operate under cryogenic conditions as by using liquid nitrogen, but this is not deemed to be economically practical.

One major advantage of the yarns made according to this invention is the versatility of such yarns. For example, a yarn with high strength, high frequency of protruding ends, short mean protruding end length with a medium bulk can be made and used to give improved aesthetics in printed goods when compared to goods made from conventional false twist textured yarn. On the other hand, a yarn with medium strength, high frequency of protruding ends with medium to long protruding end length and high bulk can be made and used to give desirable aesthetics in jersey knit fabrics for underwear or for women's outerwear.

The versatility is achieved primarily by manipulating the fracturing jet pressure and the specific cross-section of the filament. In general, increasing the fracturing jet pressure increases the specific volume and decreases the strength of the yarn.

Another major advantage of yarns made according to this invention, when compared to staple yarns, is their uniformity along their length as evidenced by a low % uster value. Typically, with the uster instrument operating in the normal mode, values of % U will be equal to or less than 6%. This property translates into excellent knittability and weavability with the added advantage that visually uniform fabrics can be produced which possess distinctly staple-like characteristics.

For purposes of discussion, the following general definitions will be employed.

By brittle behavior it is meant the failure of a material under relatively low strains and/or low stresses. In other words the "toughness" of the material expressed as the area under the stress-strain curve is relatively low. By the same token, ductile behavior is taken to mean the failure of a material under relatively high strains and/or stresses. In other words the "toughness" of the material expressed as the area under the stress-strain curve is relatively high.

By fracturable yarn it is meant a filament component of the yarn which at a preselected temperature and when properly processed with respect to frequency and intensity of the energy input will exhibit brittle behavior such that free protruding ends from the nonload-bearing filament component will result.

The following basic ideas play important roles in the yarn-making process.

1. A properly specified cross-section of the load-bearing and nonload-bearing filaments such that the fracturable component produces free protruding ends when subjected to prescribed processing conditions and the load-bearing component remains intact.

2. A process in which there is a transfer of energy from a preselected source of a specified frequency range and intensity to fibers of the properly specified cross-section at a specified temperature such that the fracturable fibers behave in a brittle manner (Bp* being between 0.03 and 0.5) and the nonfracturable fibers behave in a nonbrittle manner (Bp* >0.80), with the difference between the Bp* for the fracturable fibers and the Bp* for the nonfracturable fibers being >0.3 units.

Given properly specified cross-sections of the fracturable and the nonfracturable components and a set of processing conditions under which the fracturable component exhibits brittle behavior, the following sequence of events is believed to occur during the production of desirable yarns of the type disclosed herein.

1. The applied energy and its manner of application generates localized stresses sufficient to initiate cracks in the fracturable component of the nonload-bearing filaments.

2. The crack(s) propagates until the sections are acting as individual pieces with respect to lateral movement, thus having the ability to entangle with neighbor pieces while still being attached at the end of the crack.

3. Because of the intermingling and entangling, the total forces which may act on any given section at any instant can be the sum of the forces acting on several fibers. In this manner the localized stress on a section can be sufficient to break the section with assistance from the embrittlement which occurs. We know, for example, that mean stresses generated by the jet are at least one order of magnitude below the stresses required to break individual pieces (~0.2 G/D vs. ~2 G/D).

4. Finally it is required that the intensity and effective frequency of the force application and the temperature of the fiber are such that the break in the fracturable component is of a brittle nature, thereby providing free protruding ends of a desirable length and linear frequency as opposed to loops and/or excessively long free protruding ends which would occur if the material behaved in a more ductile manner.

We have found the following parameters to be especially useful in characterizing the process required to obtain a useful yarn with free protruding ends.

$$Bp^* = \frac{\Delta E_a \, \tau_a}{\Delta E_{na} \, \tau_{na}}$$

where

Bp* is defined as the "brittleness parameter" and is dimensionless;

$\Delta E\tau$ is a product of a strain and stress indicative of relative brittleness, where, in particular $\Delta E_{na}$ is the extension to break of the potentially fracturable yarn *without* the proposed fracturing process being operative;

$\Delta_a$ is the extension to break of the potentially fracturable yarn *with* the proposed fracturing process being operative;

$\tau_a$ is the stress at break of the potentially fracturable yarn *with* the proposed fracturing process being operative;

$\tau_{na}$ is the stress at break of the potentially fracturable yarn *without* the proposed fracturing process being operative.

The input yarn conditions are constant in the a and na modes.

These parameters are also defined in terms of process conditions. As shown in FIG. 17, the basic experiment involves "stringing up" the yarn between two independently driven rolls as shown with the specific speed of the first or feed roll $V_1$ being preselected. The surface speed of the second or delivery roll $V_2$ and the tension g in grams at the break being detected and recorded. This experiment is repeated five times with the proposed fracturing process being operative. In terms of the previously defined variables $$\Delta E_a = \frac{1}{5} \sum_{i=1}^{5} (V_{2ai} - V_1) \text{ (meters/minute)}$$

$$\Delta E_{na} = \frac{1}{5} \sum_{i=1}^{5} (V_{2ai} - V_1) \text{ (meters/minute)}$$

$$\tau_a = \frac{\frac{1}{5} \sum_{i=1}^{5} g_{ai} \frac{1}{5} \sum_{i=1}^{5} V_{2ai}}{V_1} \text{ (grams)}$$

$$\tau_{na} = \frac{\frac{1}{5} \sum_{i=1}^{5} g_{nai} \frac{1}{5} \sum_{i=1}^{5} V_{2nai}}{V_1} \text{ (grams)}$$

Obviously mechanical damage by dragging over rough surfaces or sharp edges can influence Bp* values. However, for purposes of discussion the word "process" means the actual part of the fracturing apparatus which is operated to influence fracturing only. In the case of air jets, it is the actual flow of the turbulent fluid which is used to fracture the yarn, not the dragging of the yarn over a sharp exit or entrance. Therefore the influence of the turbulently flowing fluid on Bp* is the only relevant parameter, not the mechanical damage. For example, suppose the following measurements were made with $V_1$=200 meters/minute.

| Process | | | | | | |
|---|---|---|---|---|---|---|
| Not Operative | $V_{2na}$ | 218 | 219 | 220 | 221 | 222 |
| | $g_{na}$ gms. | 200 | 205 | 195 | 200 | 200 |
| Operative | $V_{2a}$ | 208 | 208 | 209 | 210 | 210 |
| | $g_a$ gms. | 100 | 95 | 105 | 100 | 100 |

For this hypothetical example with the yarn at 23° C., $\Delta E_a$=9 meters/min.

$\Delta E_{na}$=20 meters/min.

$\tau_a$ =(100 gms.)(209 m./min.)/(200 m./min.)

$\tau_{na}$=(200 gms.)(220 m./min.)/(200 m./min.): thus, $$Bp^* = \frac{(9)\,(100)\,(209)}{(20)\,(200)\,(220)} = 0.21$$

This parameter reflects the complex interactions among the type of energy input (i.e., turbulent fluid jet, the frequency distribution of the energy input, the intensity of the energy input, the temperature of the yarn at the point of fracture, the residence time within the fracturing process environment, the polymer material from which the yarn is made and its morphology, and the cross-section shape. Obviously values of Bp* less than one suggest more "brittle" behavior. We have found values of Bp* of about 0.03 to about 0.5 for the fracturable component of the yarn to be particularly useful. Note that it is possible to have a process (usually a fluid jet) operating on a yarn with a specified fiber cross-section of a specified denier/filament made from a specified polymer which behaves in a perfectly acceptable manner with respect to Bp* and by changing only the specified polymer the resulting Bp* will be an unacceptable value reflected in poorly fractured yarn. Thus acceptable Bp* values for various polymers may require significant changes in the frequency and/or intensity of the energy input and/or the temperature of the yarn and/or the residence time of the yarn within the fracturing process.

The preferred range of values of Bp* applies to a single operative process unit such as a single air jet. Obviously cumulative effects are possible and thereby several fracturing process units operating in series, each with a Bp* higher than 0.50 (say 0.50 to 0.80), can be utilized to make the yarn described herein.

The pressures and flow rates selected for the air jets should be typical of those used under normal fracturing conditions. For example, the Nelson jet disclosed in U.S. Pat. No. 4,095,319 and discussed and employed in the disclosures of the aforementioned U.S. Pat. Nos. 4,245,001 and 4,332,761 is typically operated at a flow rate of 0.18395 standard cubic meter (6.5 scfm) at 3447.50 kilopascals (500 psi) whereas the Dyer jet disclosed in U.S. Pat. No. 2,924,868, also discussed in U.S. Pat. Nos. 4,245,001 and 4,332,761, is typically operated at 1034.25 kilopascals (150 psi) and at a flow rate of 0.7075 standard cubic meter (25 scfm). This is accomplished under standard conditions at 101.33 kilopascals (14.696 psi) at 21.11° C. (70° F.).

Turbulent fluid jets are particularly useful processes for fracturing the yarns described in this invention. Even though liquids may be used, gases and in particular air, are preferred. The drag forces generated within the jet and the turbulent intermingling of the fibers, characteristics well known in the prior art, are particularly useful in providing a coherent intermingled structure of the fractured yarns of the type disclosed herein.

See aforementioned U.S. Pat. Nos. 4,245,001 and 4,331,761 for a more detailed discussion of Bp* (brittleness parameter).

Specific Volume

The specific volume of the yarn is determined by winding the yarn at a specified tension (normally 0.1 G/D) into a cylindrical slot of known volume (normally 8.044 $cm^3$). The yarn is wound until the slot is completely filled. The weight of yarn contained in the slot is determined to the nearest 0.1 mg. The specific volume is then defined as $$\text{Specific Volume at 0.1 } G/D \text{ tension} = \frac{8.044}{\text{wt. of yarn in gms.}} \left(\frac{\text{cc.}}{\text{gm.}}\right)$$

Uster Evenness Test (% U)

ASTM Procedure D 1425—Test for Unevenness of Textile Strands.

Inherent Viscosity

Inherent viscosity of polyester and nylon is determined by measuring the flow time of a solution of known polymer concentration and the flow time of the polymer solvent in a capillary viscometer with an 0.55 mm. capillary and an 0.5 mm. bulb having a flow time of 100±15 seconds and then by calculating the inherent viscosity using the equation $$\text{Inherent Viscosity } (I.V.),\ n^{25°}_{0.50\%}\ PTCE = \ln \frac{\frac{t_s}{t_o}}{C}$$

where:

ln=natural logarithm $t_s$=sample flow time $t_o$=solvent blank flow time

C=concentration grams per 100 mm. of solvent

PTCE=60% phenol, 40% tetrachloroethane

Inherent viscosity of polypropylene is determined by ASTM Procedure D 1601.

B. Invention

The present invention provides continuous filament yarn comprising a bundle of nonload-bearing fracturable filaments and load-bearing nonfracturable filaments, each filament of said nonload-bearing fracturable filaments comprising at least one of (a) a ribbon cross-section having at least an 8:1 L/D ratio, or (b) a cross-section of two or more unbranched linear segments joined end to end and having at least an 8:1 L/D ratio, and each filament of said load-bearing nonfracturable filaments comprising at least one of (a) an undulating oblong cross-section as shown in FIG. 9, or (b) a filament spun from a spinneret orifice having a modified "W" cross-section formed from at least four plane figures joined end to end, as shown in FIG. 7, or (c) an undulating cross-section as shown in FIG. 12, said yarn having an elongation to break of equal to or less than 180% and wherein the percentage difference between the elongation to break of the nonload-bearing fracturable filaments versus the load-bearing nonfracturable filaments differs by no more than 30% based on the elongation to break of the load-bearing nonfracturable filaments, and said nonload-bearing fracturable filaments and said load-bearing nonfracturable filaments also being further characterized by dyeing compatibility to the extent that by visual inspection there is no discernible difference in color between the nonload-bearing fracturable filaments and the load-bearing nonfracturable filaments.

The continuous filament yarn may have an elongation-to-break of ≦50% and be thermally stabilized to a boiling water shrinkage ≦15%, and the nonload-bearing fracturable filaments and the load-bearing nonfracturable filaments are each compatible with the other in dyeing characteristics to the extent that by visual inspection there is no discernible difference in color between the nonload-bearing fracturable filaments and the load-bearing nonfracturable filaments.

The percentage of nonload-bearing fracturable filaments to load-bearing nonfracturable filaments in the yarn may vary about 20% to about 80%.

The yarn may be either "partially oriented" or "fully oriented", as known in the art.

Our invention is also directed to a fractured continuous yarn made from the continuous filament yarn described above and having spun-like or staple-like character, wherein the nonload-bearing filaments at random intervals along their length (a) in part define discontinuous slits of variable lengths; (b) in part are transversely broken across the width of the filament cross-sections to form filament-free ends; (c) in part are transversely broken partly across the width of the filament cross-sections and split away from the main body of each such filament to form partial filament-free ends; and (d) in part are split and broken at randomly staggered intervals across the width of the filament cross-sections to form branch-like ends. The separate free ends, the partial filament-free ends and the branch-like ends collectively form a multitude of free protruding ends extending from the yarn bundle and are generally entangled with and/or wrapped around the yarn bundle at intervals therealong and the load-bearing filaments being essentially unbroken in relation to the nonload-bearing filaments.

The fractured yarn has an elongation-to-break $\leqq 50\%$ and is thermally stabilized to a boiling water shrinkage $\leqq 15\%$, and the nonload-bearing fractured filaments and the load-bearing nonfractured filaments are each compatible with the other in dyeing characteristics to the extent that by visual inspection there is no discernible difference in color between the nonload-bearing fractured filaments and the load-bearing nonfractured filaments.

The aforementioned separate free ends, the partially-free ends and the branch-like ends have lineal portions that are randomly formed into crunodal loops, arch loops and partial loops between the ends and the yarn bundle.

The percentage of load-bearing nonfractured filaments to nonload-bearing fractured filaments in the continuous filament yarn may vary from about 20% to about 80%.

Each of the nonload-bearing fractured filaments may have a ribbon cross-section with the separate free ends, the partially-free ends and the branch-like ends being randomly formed into angled bends, projecting loops, crunodal loops and arch loops between the ends and the bundle. The ribbon cross-section of the nonload-bearing fractured filament may have at least an 8:1 L/D ratio, and the most likely initiation location for a split occurs approximately at the middle of the width of the ribbon cross-section.

The nonload-bearing fractured filaments may each have a cross-section of two or more unbranched linear segments joined end to end: the most likely initiation location for a split occurs approximately at the outermost intersection of the unbranched segments across the width of the unbranched linear segments.

The fractured continuous filament yarn may have a tenacity of at least 1.50 grams per denier, an elongation of about 15% to about 30%, a modulus of about 30 to about 60 grams per denier, a boiling water shrinkage of about 1% to about 8%, and a specific volume at 0.1 grams per denier tension of at least 1.5 cubic centimeters per gram.

The load-bearing nonfractured filament has an undulating cross-section, such as shown in FIG. 9, as spun from a spinneret orifice such as shown in FIG. 8 and having an elongated slot the shape of which defines a series of offset repeating parallelograms connected together, each parallelogram having a pair of opposite sidewalls "a" substantially parallel to the minor axis of the slot and a pair of opposite sidewalls "b" substantially parallel to the major axis of the slot, and wherein a sidewall "a" of one parallelogram and the sidewall "a" of the adjacent offset parallelogram lie in a common plane. In the latter-described spinneret orifice, the width of the slot between and connecting adjacent parallelograms has a normalized dimension of one (1) unit, sidewall "a" has a normalized dimension ranging from two (2) to four (4) units and sidewall "b" has a normalized dimension ranging from one and one-half ($1\frac{1}{2}$) to six (6) units. The number of repeating parallelograms in the spinneret orifice ranges from three (3) to six (6) in the series. Also in the spinneret orifice each parallelogram has one set of included, opposed angles $\alpha$ and one set of included opposed angles $180° - \alpha$; angle $\alpha$ ranges from about 90° to about 135°.

The load-bearing nonfractured filament may also be spun from a spinneret orifice having a modified "W" cross-section formed from at least four plane figures joined end to end as shown in FIG. 7, wherein (a) each of the two outer plane figures is identical to the other and defines, respectively, four sides identified in FIG. 7 as a, b, c and d, and each of the two intermediate plane figures is identical to the other, is adjacent to one of the outer planes and defines, respectively, five sides identified in FIG. 7 as e, f, g, h and i, with each side d of an outer plane figure being conjoined and coaligned with side f of an adjacent intermediate plane figure, and (b) with each side i of the intermediate plane figure being conjoined and coaligned with side i of the other intermediate plane figure.

The interior angle formed between side c of an outer plane figure and side g of an adjacent intermediate plane figure of the modified "W" cross-section of the spinneret orifice is equal to or less than 90°.

Side a of each outer plane figure of the modified "W" cross-section of the spinneret orifice has a normalized dimension of about six (6), each side b of each said outer plane figure has a normalized dimension of about three (3), and sides d, f and i each has a normalized dimension of about one (1).

The load-bearing filament may be further spun from a spinneret orifice having an undulating cross-section formed from at least seven rectangular linear segments joined end to end at alternating right angles, as shown in FIG. 11. The width of each linear segment may have a normalized dimension of one (1) and length of each linear segment may have a normalized dimension of four (4).

Our invention is further directed to a process for fracturing a continuous filament textile yarn comprising a bundle of nonload-bearing fracturable filaments and load-bearing nonfracturable filaments, the yarns having an elongation-to-break of equal to or less than 180% and wherein the percentage difference between the elongation-to-break of the nonload-bearing fracturable filaments versus the load-bearing nonfracturable filaments differs by no more than 30% based on the elongation-to-break of the load-bearing nonfracturable filaments, with the load-bearing filaments having a brittleness parameter (Bp*) $>0.80$, wherein the process comprises fracturing the nonload-bearing filament portion of the yarn utilizing a fluid fracturing jet operating at a brittleness parameter (Bp*) of about 0.03 to 0.5 for the yarn being fractured, the difference between the brittleness parameter (Bp*) for the fracturable filaments and the brittleness parameter (Bp*) for the nonfracturable filaments being ≧0.3 units.

"Elongation-to-break", as used herein, is a function of molecular orientation, filament cross-section, denier per filament, and uniformity along the length of the yarn. Molecular orientation is influenced by the temperature of the polyester polymer as it is spun or extruded through a spinneret and the take-up speed of the spun filaments, by the condition of quenching or cooling in the spinning cabinet through which the filaments pass after being spun, by melt viscosity, and any subsequent drawing that may be performed. Melt viscosity can be affected by the levels of diethylene glycol (DEG) in the polyester polymer, molecular weight, and the temperature of the melt.

In spinning polyester fiber, one of the objectives is to meet a specified approximate elongation-to-break. Approximate ranges of spinning temperatures, take-up speeds, rates of quenching and cooling, melt viscosities and any subsequent drawing that may be performed necessary to achieve this objective are generally known. Naturally, it is necessary to test the spun fiber to see how closely this objective has been met, and if the test results are off in any respect, conditions are changed so that the subsequent resulting spun fibers meet the objective.

"Boiling water shrinkage" as recited depends upon time and temperature exposure, orientation, and crystallinity, and by varying the thermal history of a yarn from polyester polymer, one can obtain a desired boiling water shrinkage.

The yarn referred to in the process may be a poly-(ethylene terpehthalate) yarn.

The fluid fracturing jet in the process may be operated at a brittleness parameter (Bp*) of about 0.03 to about 0.4 based on the fracturable filament.

The specific volume of the fractured yarn may be made to vary along the yarn strand by varying the fracturing jet air pressure.

Thus traditional spun yarns, i.e. yarns made from staple fibers, offer desirable aesthetic qualities which cannot be duplicated by conventional texturing of continuous filament yarns. Most of these desirable aesthetic qualities can be attributed to the free ends which protrude from the spun yarn bundle.

The textile yarn of this invention, therefore, may be further characterized in terms of shadowgraph measurements by which the quantity of material protruding from the yarn body per unit time may be determined. U.S. Pat. No. 3,712,743 entitled "Apparatus for Detecting and Measuring Yarn Defects and Irregularities" (1973) discloses an apparatus by which these shadowgraph measurements may be made. To paraphrase from the summary of the invention in the patent: As a yarn strand moves through the apparatus, the yarn strand is directly illuminated, and reflected light from broken filaments and the like which extend from the surface of the normal body of the yarn strand are detected and measured or counted as desired. Light that is reflected from the normal body of the yarn strand is prevented from being detected by a shadowbar, which is positioned between the moving yarn strand and the light reflection detection apparatus. The shadowbar is positioned so as to be located beyond the path of illumination that is illuminating the yarn strand and is of such dimension as to be larger than the normal body diameter of the yarn strand so as to block off reflected light from the normal body of the yarn strand.

The prinicipal components of the apparatus described in U.S. Pat. No. 3,712,743 may include a shadowbar detector, a single-stage voltage follower amplifier, a Brush Mark II recorder, a Datascan Model 520 digital panel meter, and an electronic signal average and variability measuring instrument. The shadowbar detector involves a calibrated light source, a photosensitive detector with viewing slit, and a bar which is just larger than the yarn core diameter.

In use of the aforedescribed apparatus a guide and take-up system may be arranged so that the yarn may be drawn through the apparatus under constant tension at the rate of 86 meters per minute, for example. A time-varying signal from the detector may be processed through an electronic device which determines time average of the signal from the shadowbar detector and time average absolute deviation from the mean. This provides an analog estimate of the arithmetic means of the signal and its average absolute deviation from the mean. The signal from the shadowbar detector provides not only an input to the aforementioned electronic device, but also provides an input to a conventional oscillographic strip chart recorder which has a frequency response of about 30 cycles per second. The strip chart for the recorder has forty (40) divisions with the signal base line set at 50% of full scale. The measurements of the time average absolute deviation from the mean of the signal from the shadowbar detector are calibrated to be expressed in recorder chart divisions. The units or numbers so expressed are arbitrary but their magnitudes serve to provide a basis for determining the aforementioned quantity of material protruding from the yarn body.

The shadowbar apparatus thus gives a single parameter to describe in effect the yarn fuzziness. This parameter is identified as a variability number V, which in other words means the time average absolute deviation from the mean, and is determined in the following manner:

$$\bar{V} = \frac{\int_0^T |s(t) - \bar{s}(t)|\,dt}{T} = \text{shadowgraph variability}$$

wherein s(t) = voltage signal from shadowbar detector (which is a function of time)

$\bar{s}(t)$ = time average value of voltage signal dt = symbol of integration

T = total length of time over which integration takes place (period of integration)

The measurement of the free protruding filament ends and their distribution along the length of the yarn may also be measured in the manner disclosed in U.S. Pat. No. 4,245,001 and U.S. Pat. No. 4,332,761. See the discussion therein concerning "hairiness" or "hairiness characteristics".

An object of the invention is to provide a continuous filament yarn for textile use, the yarn having load-bearing nonfracturable filament components and nonload-bearing fracturable filament components, the two filament components with respect to each other having drafting compatibility.

Another object of this invention is to provide a continuous filament yarn which possesses spun-like or staple-like yarn character.

Still another object of this invention is to provide a continuous filament yarn with spun-like or staple-like yarn character which does not require subsequent twisting.

A further object is to provide a yarn product useful for apparel and home furnishings type fabrics.

A still further object is to provide a process for fracturing the continuous filament yarn.

Other objects inherent in the nature of this invention will be apparent to those skilled in the art to which this invention pertains.

BRIEF DESCRIPTION OF DRAWINGS

The details of our invention will be described in connection with the accompanying drawings, in which.

BEST MODE FOR CARRYING OUT THE INVENTION

As previously stated, the present invention concerns a continuous filament yarn comprised of a bundle of nonload-bearing fracturable filaments and load-bearing nonfracturable filaments which are essentially compatible in drafting, and to a yarn made from such continuous filament yarn and fractured to have spun-like or staple-like character with the nonload-bearing filaments being variably broken and having free ends either entangled with and/or projecting from the yarn bundle.

The basic concept, therefore, involves the combination of a filament component which can be fractured in a high-speed jet of air to provide protruding ends and a filament component which is relatively undistrubed by the jet of air. It would be highly desirable if the fracturable filament component could be utilized by itself. Unfortunately, the strength of the fracturable filament component, when fractured enough to provide desirable aesthetics, is not sufficient to provide a good textile yarn. In addition to the breaking of the fracturable component, an appropriate amount of entangling and tying down of the free ends within the total yarn bundle is required.

Since there are basic fiber cross-sectional differences between a fracturable fiber and a nonfracturable fiber, consideration must be given to selecting components which have dyeing compatibility when dyeability to solid shades is required. Obviously, of course, if a heather effect is desired, dyeing compatibility will not be required. If single-end processing is desired, i.e. that the fracturable fibers and the nonfracturable fibers are contained in the same end, the drafting compatability of the components must also be considered.

The criteria, therefore, for the nonfracturing or load-bearing component are that it must have drafting compatibility, must have dyeing compatibility (if dyeability to solid shades is required), must have minimum loss in strength during passage through the air fracturing jet, and the spinneret orifice through which the load-bearing fiber component is spun should be easy to fabricate.

As heretofore mentioned with respect to "drafting compatibility", the percentage difference between the elongation-to-break of the nonload-bearing fracturable filaments versus the load-bearing nonfracturable filaments differs by no more than 30% based on the elongation-to-break of the load-bearing nonfracturable filaments. For example if the elongation-to-break of the load-bearing component is 130% and the elongation-to-break of the fracturable component is 110%, then the percentage difference based on the load-bearing component is $$\frac{(130 - 110)}{130} \times 100 = 15.4\%$$

thus this example would be within the scope of our claims.

Figure 7:
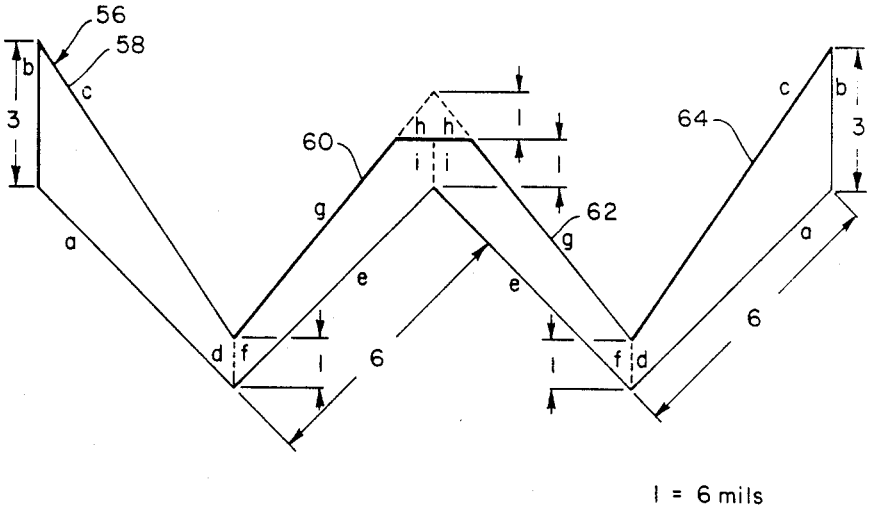
FIG. 7 is an illustration of a "W"-shaped spinneret orifice from which load-bearing filaments may be spun.

We have discovered quite unexpectedly that "W" cross-section fibers can be fractured quite readily in an air jet and will provide the desirable protruding ends in the fractured yarn. We have also found quite unexpectedly that fibers spun from a spinneret orifice of the type shown in FIG. 7 are essentially unchanged when subjected to the same conditions which fracture the "W" cross-section fibers. In addition, fibers spun from the spinneret orifices in FIGS. 8, 10 and 11 possess similar drafting and dyeing characteristics to the "W" cross-section fibers.

We also must point out that any fiber cross-section can be made to fracture if the conditions in the air jet are made sufficiently severe. One of the key advantages of the "W" cross-section fiber is that the severity required is easily achieved (i.e. 689.50 to 1068.50 kilopascals [100 to 300 psi] in a standard acetate lofting jet at speeds up to 1000 meters per minute and possibly greater.

We have found that the major advantages of this product are improved strength, improved spun-like character, reduced glitter and reduced dust formation during fracturing.

Typical product specifications necessary for textile utility are:

| | |
|---|---|
| tenacity | ≧1.50 g/d |
| elongation | 15–30% |
| modulus | 30–60 g/d |
| boiling water shrinkage | 1–8% |
| specific volume at 0.1 gram/denier tension | ≧1.5 cc/g |
| shadowgraph | 3–10 |

The examples in TABLE 1 show the influence of internal angle of the "W" cross-section spinneret on shadowgraph, glitter, dust formation and brittleness parameters for the load-bearing nonfracturable filaments ($Bp^*_L$) and for the nonload-bearing fracturable filaments ($Bp^*_F$) made from a polyester polymer such as poly(ethylene terephthalate). The brittleness parameter ($Bp^*_L$) for the nonfracturable component will be >0.80, and the brittlenss parameter ($Bp^*_F$) for the fracturable component will be between about 0.03 and 0.5 with the difference between $Bp^*_F$ and $Bp^*_L \geqq 0.3$ units. The brittleness parameter (Bp*) can only be measured on one group of filaments at a time, such as the nonfracturable filaments, and then the fracturable components. The measurement is made prior to passage of the yarn containing the two components through an air jet. All examples in TABLE 1 were made at 400 meters/minute take-up speed with about 4% overfeed and using a conventional lofting jet for the air jet, such as the Dyer jet disclosed in U.S. Pat. No. 2,924,868, operated at 1034.25 kilopascals (150 psi) and 0.7075 standard cubic meters (25 scfm).

TABLE 1

| Example | Den./Fil. Fracturing Component | Den./Fil. Load-Bearing Component | Angle in Spinneret of Fracturing Component | Shadowgraph | Rank of Glitter | Rank of Dust Formation | $Bp^*_L$ | $Bp^*_F$ |
|---|---|---|---|---|---|---|---|---|
| 1 | 90/30 | 70/36 round | 45° "W" | 2.35 | Least | Lowest | 0.90 | 0.70 |
| 2 | 90/30 | 70/36 round | 60° "W" | 3.41 | | | 0.90 | 0.50 |
| 3 | 90/30 | 70/36 round | 75° "W" | 3.97 | | | 0.90 | 0.40 |
| 4 | 90/30 | 70/36 round | 90° "W" | 5.76 | | | 0.90 | 0.30 |
| 5 | 90/30 | 70/36 round | 105° "W" | 7.57 | Most | Highest | 0.90 | 0.15 |

The following examples in TABLE 2 also show the influence of internal angle of the "W" cross-section spinneret on shadowgraph, glitter, and dust formation. All examples were made at 400 meters/minute take-up speed with 3% overfeed using the air jet mentioned in the discussion of TABLE 1.

TABLE 2

| Example | Den./Fil. Fracturing Component | Den./Fil. Load-Bearing Component | Angle in Spinneret of Fracturing Component | Shadowgraph | Rank of Glitter | Rank of Dust Formation |
|---|---|---|---|---|---|---|
| 1 | 120/30 | 70/36 round | 45° "W" | 2.7 | Least | Lowest |
| 2 | 120/30 | 70/36 round | 60° "W" | 4.6 | | |
| 3 | 120/30 | 70/36 round | 105° "W" | 10.3 | | |
| 4 | 120/30 | 70/36 round | 165° "W" | 19.8 | Most | Highest |

The examples in TABLE 3 further show the influence of internal angle of the "W" cross-section spinneret on shadowgraph, glitter, and dust formation. All examples were made at 200 meters/minute with 2.5% overfeed using the air jet mentioned in the discussion of TABLE 1.

TABLE 3

| Example | Den./Fil. Fracturing Component | Den./Fil. Load-Bearing Component | Angle in Spinneret of Fracturing Component | Shadowgraph | Rank of Glitter | Rank of Dust Formation | $Bp^*_L$ | $Bp^*_F$ |
|---|---|---|---|---|---|---|---|---|
| 1 | 120/30 | 70/36 round | 45° "W" | 8.9 | Least | Lowest | 0.90 | 0.65 |
| 2 | 120/30 | 70/36 round | 60° "W" | 7.5 | | | 0.90 | 0.45 |
| 3 | 120/30 | 70/36 round | 75° "W" | 8.8 | | | 0.90 | 0.35 |
| 4 | 120/30 | 70/36 round | 90° "W" | 12.0 | | | 0.90 | 0.20 |
| 5 | 120/30 | 70/36 round | 105° "W" | 10.5 | | | 0.90 | 0.10 |
| 6 | 120/30 | 70/36 round | 120° "W" | 14.9 | | | 0.90 | 0.08 |
| 7 | 120/30 | 70/36 round | 135° "W" | 14.0 | | | 0.90 | 0.06 |
| 8 | 120/30 | 70/36 round | 150° "W" | 15.2 | | | 0.90 | 0.05 |
| 9 | 120/30 | 70/36 round | 165° "W" | 15.1 | Most | Highest | 0.90 | 0.04 |

The following examples in TABLE 4 show the experiment that was used to select the load-bearing filament component. The criteria were that: (1) it must have drafting compatibility; (2) it must have dyeing compatibility; (3) it must have the minimum loss in strength during fracturing; and (4) the spinneret should be easy to fabricate.

TABLE 4

Figure 8:
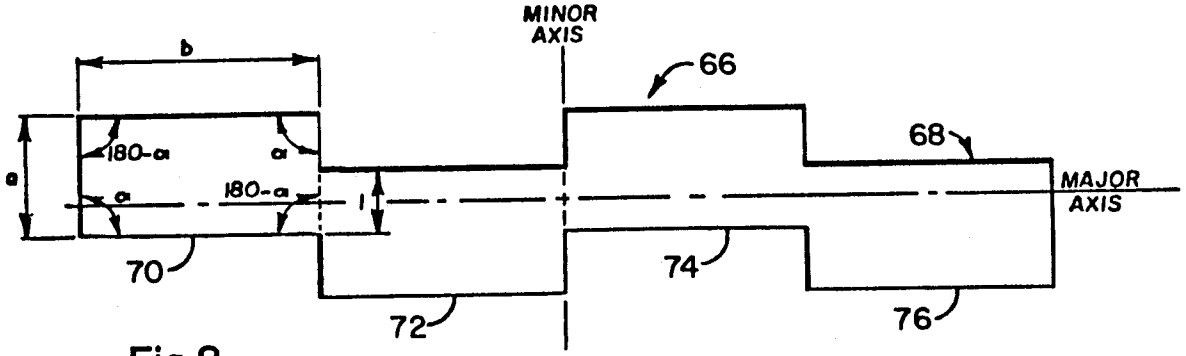
FIG. 8 is a plan view of a spinneret orifice in the form of an elongated slot characterized by a series of connected off-set parallelograms.
Figure 11:
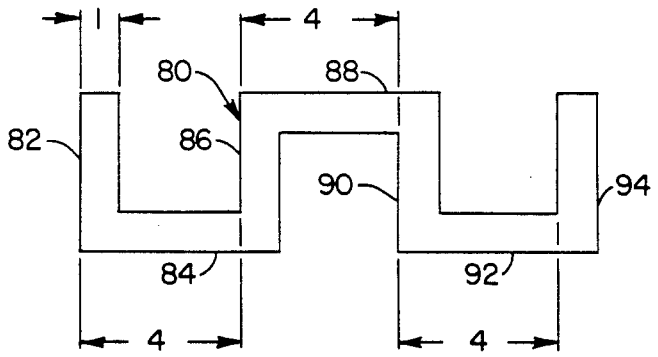
FIG. 11 is a plan view of another spinneret orifice through which a load-bearing or nonfracturable fiber may be spun.

| Example | Load-Bearing Component Den./Fil. | Load-Bearing Component Spinneret | Fracturing Component Den./Fil. | Fracturing Component Spinneret | Yarn Tenacity G/Den. | Yarn Tenacity Rank |
|---|---|---|---|---|---|---|
| 1[1,2] | 120/30 | 45° "W" | 120/30 | 165° "W" | 1.75 | 6 |
| 2 | 120/30 | 45° "W" | 120/30 | 165° "W" | 1.73 | 7 |
| 3 | 120/30 | 45° "W" | 120/30 | 165° "W" | 1.79 | 5 |
| 4 | 120/30 | FIG. 7 | 120/30 | 165° "W" | 2.07 | 3 |
| 5 | 120/30 | FIG. 11 | 120/30 | 165° "W" | 2.06 | 4 |
| 6 | 120/30 | FIG. 11 | 120/30 | 165° "W" | 1.67 | 8 |
| 7 | 120/30 | FIG. 8 | 120/30 | 165° "W" | 2.31 | 1 |
| 8 | 70/36 | round | 120/30 | 165° "W" | 2.20 | 2 |

[1]800 meters/min. 999.775 kilopascals (145 psig) air, 1% overfeed.
[2]Examples 1 through 8 have drafting and dyeing compatibility with 165°.

The spinneret cross-section shown as being used in Example 7 was selected to spin the load-bearing filament component. It will be noted that its superiority is small over some other filament cross-sections; however, it has a distinct advantage in spinneret manufacuture.

This series of examples in TABLE 5 shows the influence of the percent of load-bearing filament component on final yarn tenacity at constant conditions. All examples were made at 200 meters/minute at 0.5% overfeed and at 999.775 kilopascals (145 psig) air pressure.

TABLE 5

| Example | Load-Bearing Component Den./Fil. | Load-Bearing Component Spinneret | Fracturing Component Den./Fil. | Fracturing Component Spinneret | % Load-Bearing | Tenacity | $Bp^*_L$ | $Bp^*_F$ |
|---|---|---|---|---|---|---|---|---|
| 1 | 60/15 | FIG. 8 | 180/45 | 165° "W" | 25 | 1.08 | 0.80 | 0.04 |
| 2 | 80/20 | FIG. 8 | 160/40 | 165° "W" | 33 | 1.39 | 0.80 | 0.04 |
| 3 | 120/30 | FIG. 8 | 120/30 | 165° "W" | 50 | 1.54 | 0.80 | 0.04 |
| 4 | 160/40 | FIG. 8 | 80/20 | 165° "W" | 67 | 2.36 | 0.80 | 0.04 |
| 5 | 180/45 | FIG. 8 | 60/15 | 165° "W" | 75 | 2.64 | 0.80 | 0.04 |

This series of examples in TABLE 6 shows the comparison of the 165° angle yarns with the 180° (slot) angle yarns which have been reported in the prior art.

TABLE 6

| Example | Fracturing Component Den./Fil. | Fracturing Component Spinneret | Load-Bearing Component Den./Fil. | Load-Bearing Component Spinneret | Shadowgraph | Specific Volume | Rank of Glitter | | Rank of Dust Formation | |
|---|---|---|---|---|---|---|---|---|---|---|
| 1 | 120/30 | 180° | 70/36 | round | 17.3 | 3.42 | Most | 1 | Most | 1 |
| 2 | 120/30 | 165° "W" | 70/36 | round | 19.6 | 3.66 | | 3 | | 2 |
| 3 | 120/30 | 180° | 70/36 | round | 9.8 | 2.39 | | 2 | | 3 |
| 4 | 120/30 | 165° "W" | 70/36 | round | 11.3 | 2.74 | Least | 4 | Least | 4 |

Figure 15:
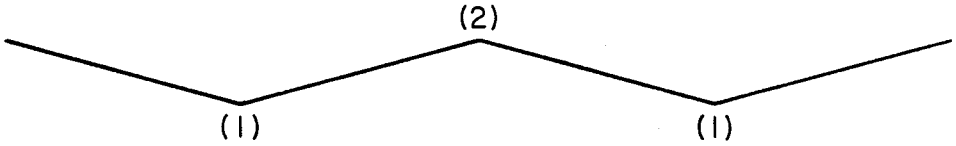
FIG. 15 is a diagrammatic view of a 165° "W" cross-section filament illustrating most likely fracturing locations.
Figure 16:
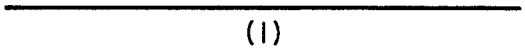
FIG. 16 is a diagrammatic view of a 180° slot filament cross-section illustrating the most likely fracture initiation location.

Microscopic examination of the fractured fibers showed a major difference between the 165° and 180° yarns. The 165° fibers have preferred fracturing locations, which are shown in FIG. 15. The (1) locations represent the most likely fracture initiation point with the (2) location being less likely. On the other hand, the 180° slot as shown in FIG. 16, showed a most likely fracture initiation point in the middle with a distribution of locations also evident. This difference manifests itself in the softness of the fabric. For example in the 165° case, the protruding pieces are predominantly one-quarter the denier per filament of the individual filaments with some pieces being one-half the denier per filament of the individual filaments, together with a spectrum of other sizes.

The examples in TABLE 7 show the difficulty in fracturing polymers which are less brittle than poly(ethylene terephthalate).

TABLE 7

| Example | Fracturable Component Polymer | Fracturable Component Den./Fil. | Fracturable Component Spinneret Angle | Load-Bearing Component | Shadowgraph | $Bp^*_L$ | $Bp^*_F$ |
|---|---|---|---|---|---|---|---|
| 1 | Nylon 6 | 140/30 | 150° "W" | 70/36 PET | 3.5 | 0.90 | 1.00 |
| 2 | T4[1] | 130/30 | 150° "W" | 70/36 PET | 14.2 | 0.90 | 0.50 |

TABLE 7-continued

| Example | Fracturable Component Polymer | Den./Fil. | Spinneret Angle | Load-Bearing Component | Shadow-graph | $Bp^*_L$ | $Bp^*_F$ |
|---|---|---|---|---|---|---|---|
| 3 | Polypropylene | 170/30 | 150° "W" | None | 24.0 | | 0.75 |

[1]Poly(tetramethylene terephthalate)

The examples above demonstrate a large number of combinations of load-bearing nonfracturable filament components and nonload-bearing fracturable filament components which can be used to make useful products. Moreover, the cross-section of the fracturable filament component might have 8 to 1 legs instead of 6 to 1 shown in FIG. 6. They also might be an 8 to 1 leg joined to a 4 to 1 leg joined to a 4 to 1 leg joined to an 8 to 1 leg instead of four 6 to 1 legs joined together. Also V's will work with 6 to 1 and 12 to 1 legs. The key seems to be in providing a length/width in the drafted cross-section ≧8. Polymers such as nylon 66, nylon 6, polypropylene, poly(1,4-cyclohexylenedimethylene terephthalate) and the like can also be used.

Figure 1A:
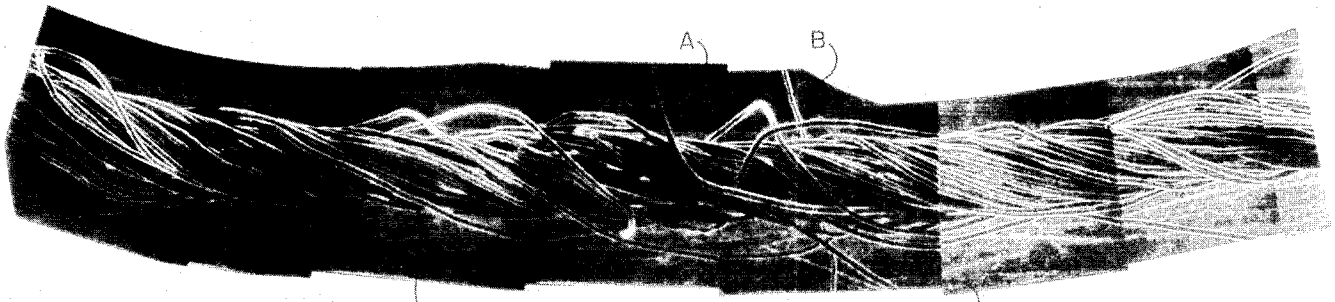
FIGS. 1A and 1B are two halves of a photomosaic of a series of photomicrographs taken of about an 0.5 centimeter length of conventional polyester staple yarn of the prior art taken at 200 magnification (200X), with FIG. 1A being the left half and FIG. 1B being the right half, respectively, of the photomosaic.
Figure 1B:
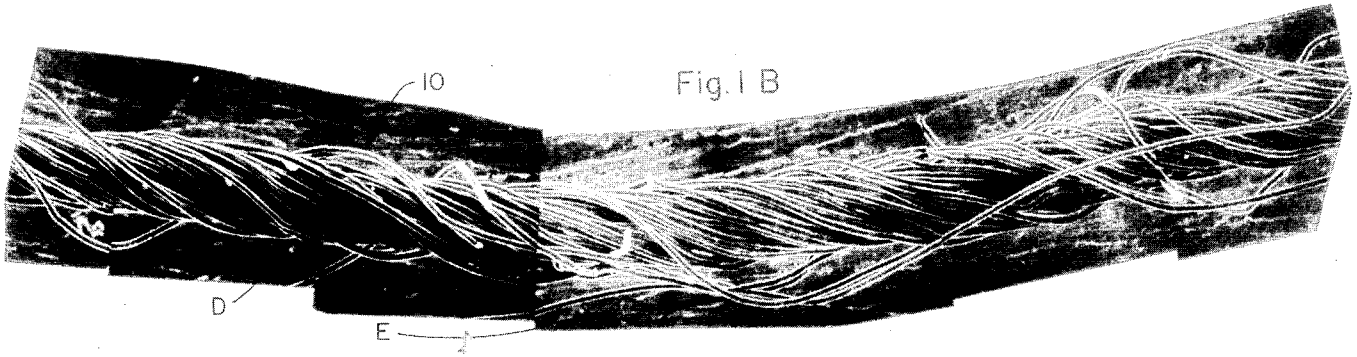

In reference, therefore, to FIGS. 1A and 1B, a series of photomicrographs joined to form a photomosaic to show a 0.5 centimeter length of yarn 10 taken at 200 magnification and made from about 3.81 centimeters (about 1.5 inch) staple fibers, the fibers having been spun from a polyester polymer such as poly(ethylene terephthalate). The purpose of this illustration is to compare the frequency of filament protrusions from the yarn body along the length of the staple fiber yarn with the frequency of filament protrusions from the yarn body that occur in the continuous filament yarns processed in accordance with the disclosure given herein. Significant filament protrusions in FIGS. 1A and 1B appear to occur at locations A, B, C, D, and E.

FIGS. 2A and 2B through FIGS. 5A and 5B each comprise a series of photomicrographs joined to form a photomosaic to show about a one (1) centimeter length of continuous filament yarn taken at 100 magnification to illustrate the greater frequency of filament protrusions from the main body of the yarn. All of the filaments in the yarn 12 shown in FIGS. 2A and 2B, for example, are nonload-bearing filaments spun from a spinneret orifice having a 90° "W" cross-section. This is not a practical yarn from the commercial standpoint because the strength of the yarn due to the fractured filaments is not sufficient to provide a good textile yarn unless additional twist is provided. Yarn 12 shows a number of free protruding filament ends. For example, the free protruding end 14 is tapered to a point while free protruding end 16 is broken across its width to form a blunt end. A discontinuous slit in one of the filaments is shown at 18; this is a slit or separation occurring in the filament and extending for a short distance along the length of the filament but without fracturing either completely or partially across the width of the filament. A "free protruding end" may start out as a slit and then fracture completely or partially across the width or may fracture completely across the filament width without having been started from a split. A free end may or may not become entangled with the yarn bundle and then either bury itself into the bundle or protrude from the yarn bundle. Many barbs will occur as part of the fracturing process which contribute in part to the overall textile aesthetics due to the resulting tactile sensations they produce. A "barb" is shown, for example, at 20 and at 22, and is a short, pointed projection occurring along the edge of a filament and usually results as a consequence of the filament split or separation. A branch-like end, for example, is shown at 24. A projecting loop is shown, for example, at 26, and contributes in part to the overall textile aesthetics and tactile sensations. The ridge-like configuration of the filaments, as shown for example at 28, is a consequence of the filaments' having been spun from a "W" cross-section spinneret orifice, this configuration's being readily conducive to fracturing in the manner illustrated. Note, for instance, the fracture or separation that has been initiated at 30 and follow its course to the right, as viewed from the photograph, as it extends into and forms part of the yarn bundle. Arch loops are shown, for example, at 32 and at 34.

Figure 2A:
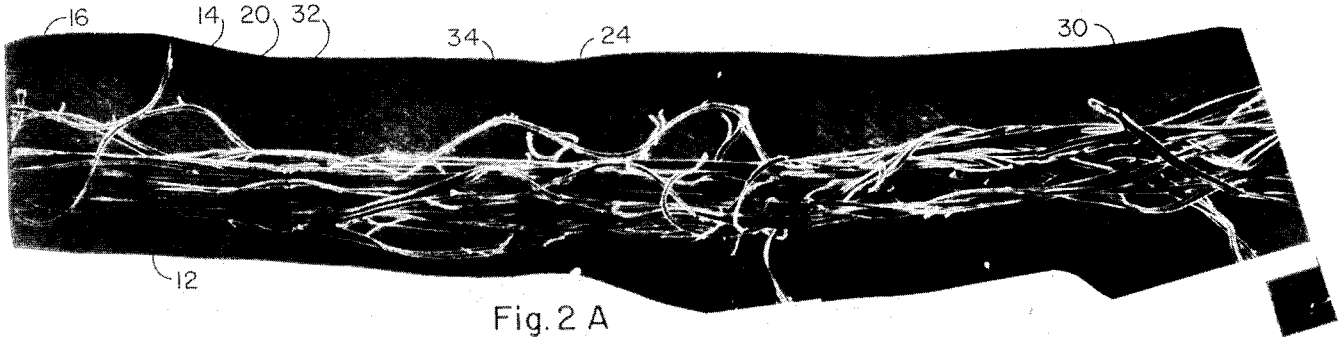
FIGS. 2A and 2B are two halves of a photomosaic of a series of photomicrographs taken of about a 1.0 centimeter length of polyester continuous yarn taken at 100 magnification (100X) with FIG. 2A being the left half and FIG. 2B being the right half, respectively, of the photomosaic, and processed in accordance with the present invention, wherein all of the filaments illustrated are spun from a 90° "W" cross-section spinneret orifice and all of the filaments are nonload-bearing filaments.
Figure 2B:
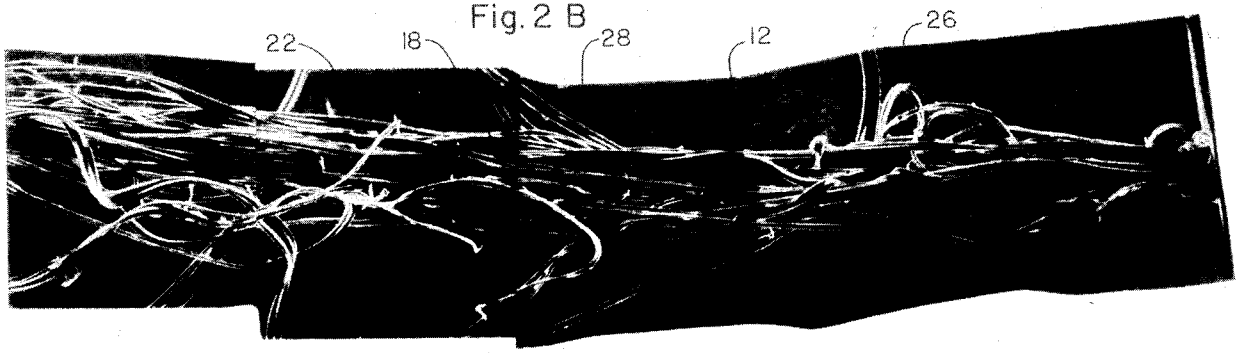

These various phenomena of the free protruding ends, discontinuous slits, barbs, branch-like ends and others not mentioned as yet or shown with respect to FIGS. 2A and 2B will be shown in greater detail when the individual photomicrographs are described.

Figure 3A:
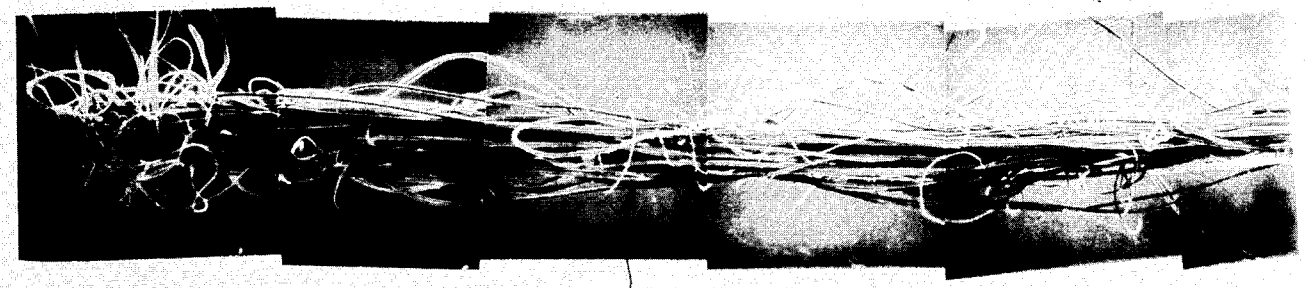
FIGS. 3A and 3B are two halves of a photomosaic of a series of photomicrographs taken of about a 1.0 centimeter length of polyester continuous filament yarn taken at 100 magnification (100X), with FIG. 3A being the left half and FIG. 3B being the right half, respectively, of the photomosaic, and processed in accordance with the present invention, wherein the load-bearing filaments are spun through a round cross-section spinneret orifice and the nonload-bearing filaments are spun through a 45° "W" cross-section spinneret orifice.
Figure 3B:
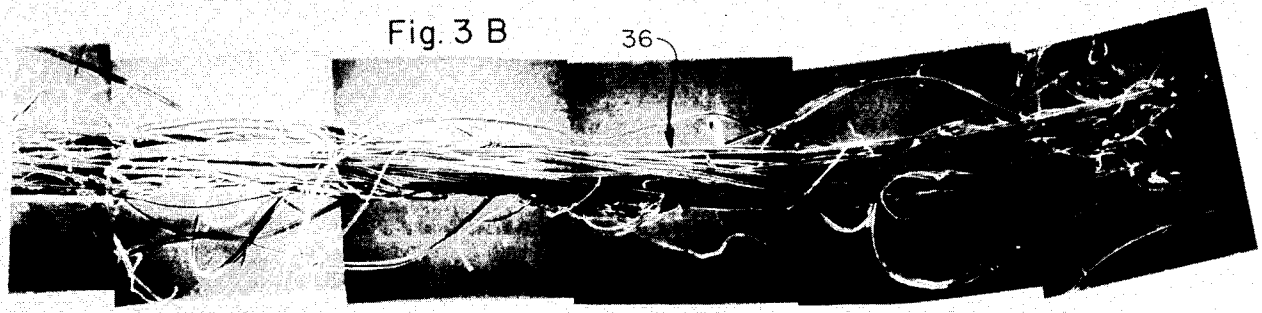

FIGS. 3A and 3B show a yarn 36 that has both nonload-bearing and load-bearing filament components. The load-bearing filament components were spun through a conventional round cross-section spinneret orifice while the nonload-bearing filament components were spun through a 45° "W" cross-section spinneret orifice. The profusion of entanglements, free protruding ends, projecting loops and other characteristic phenomena appear more evident. This yarn, for example, was passed through a conventional lofting jet, such as the Dyer jet as shown by U.S. Pat. No. 2,924,868, at a speed of about 104 meters per minute, the air pressure in the jet being about 1034.25 kilopascals (150 psi).

Figure 4A:
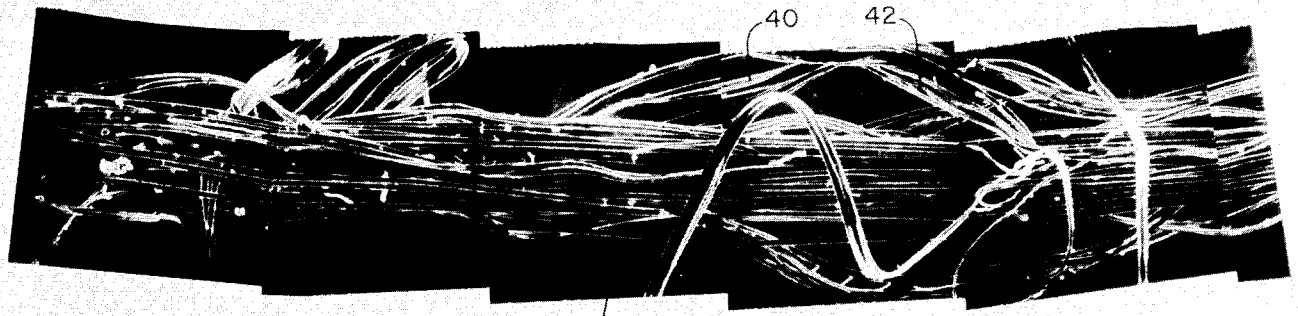
FIGS. 4A and 4B are of a series of photomicrographs taken of about a 1.0 centimeter length of polyester continuous filament yarn taken at 100 magnification (100X) with FIG. 4A being the left half and FIG. 4B being the right half, respectively, of the photomosaic, and processed in accordance with the present invention, and wherein the load-bearing filaments are spun through a round cross-section spinneret orifice and the nonload-bearing filaments are spun through a 90° "W" cross-section spinneret orifice.
Figure 4B:
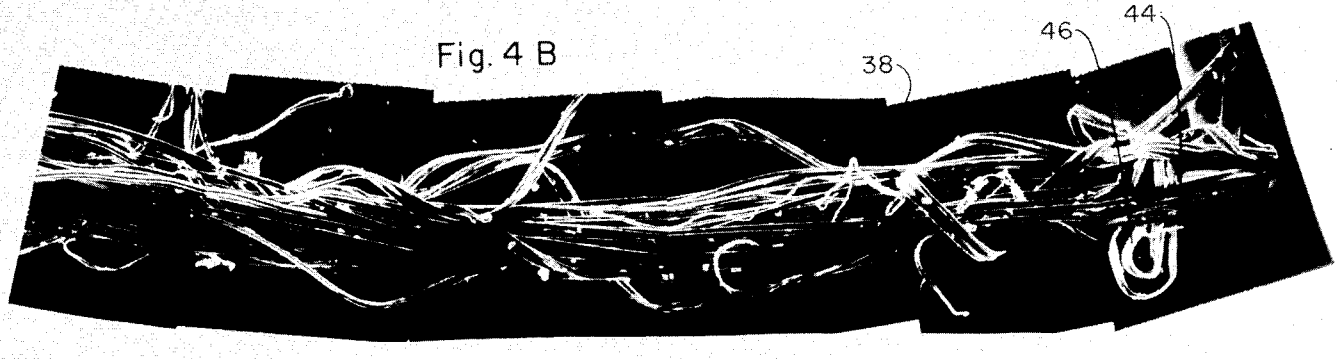
Figure 5A:
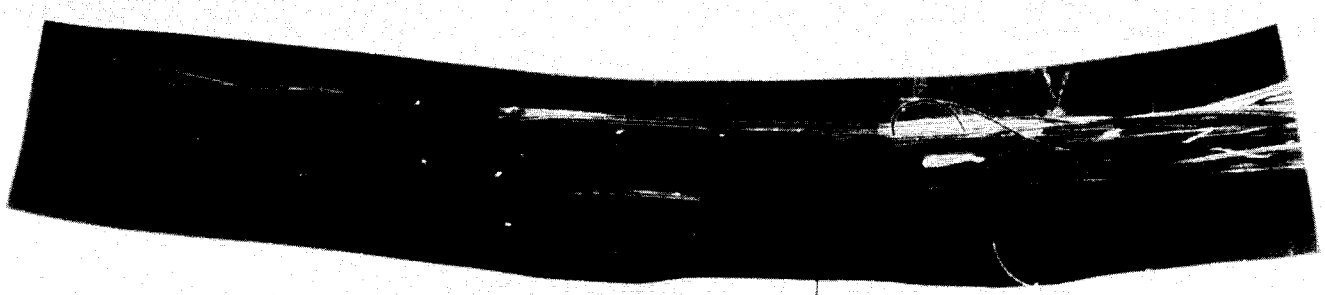
FIGS. 5A and 5B are two halves of a photomosaic of a series of photomicrographs taken of about a 1.0 centimeter length of polyester continuous filament yarn taken at 100 magnification (100X), with FIG. 5A being the left half and FIG. 5B being the right half, respectively, of the photomosaic, and processed in accordance with the present invention, and wherein the load-bearing filaments are spun through a round cross-section spinneret orifice and the nonload-bearing filaments are spun through a 45° "W" cross-section spinneret orifice.
Figure 5B:
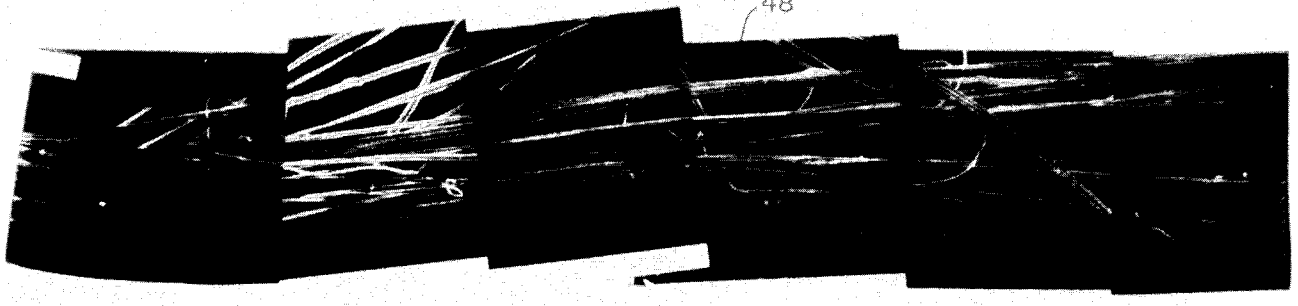

FIG. 4 shows a yarn 38 having round cross-section load-bearing filament components and a nonload-bearing filament component that were spun from a 90° "W" cross-section spinneret orifice. Note, for example, the discontinuous slit shown at 40, and also at 42, and the barb 44 formed in one edge of the projecting loop 46. A projecting loop, for instance, tends to present a stiffer resistance than a free protruding end, for example, and yet the arch-like surface of the loop presents a softer tactile sensation than the point-like end of a free protruding end.

FIG. 5 shows a yarn 48 in which the load-bearing filament component was spun through a round cross-section spinneret orifice while the nonload-bearing filament component was spun through a 45° "W" cross-section spinneret orifice. This yarn was passed through an air jet at about 1034.25 kilopascals (150 psi) at a speed of about 416 meters per minute.

Figure 6:
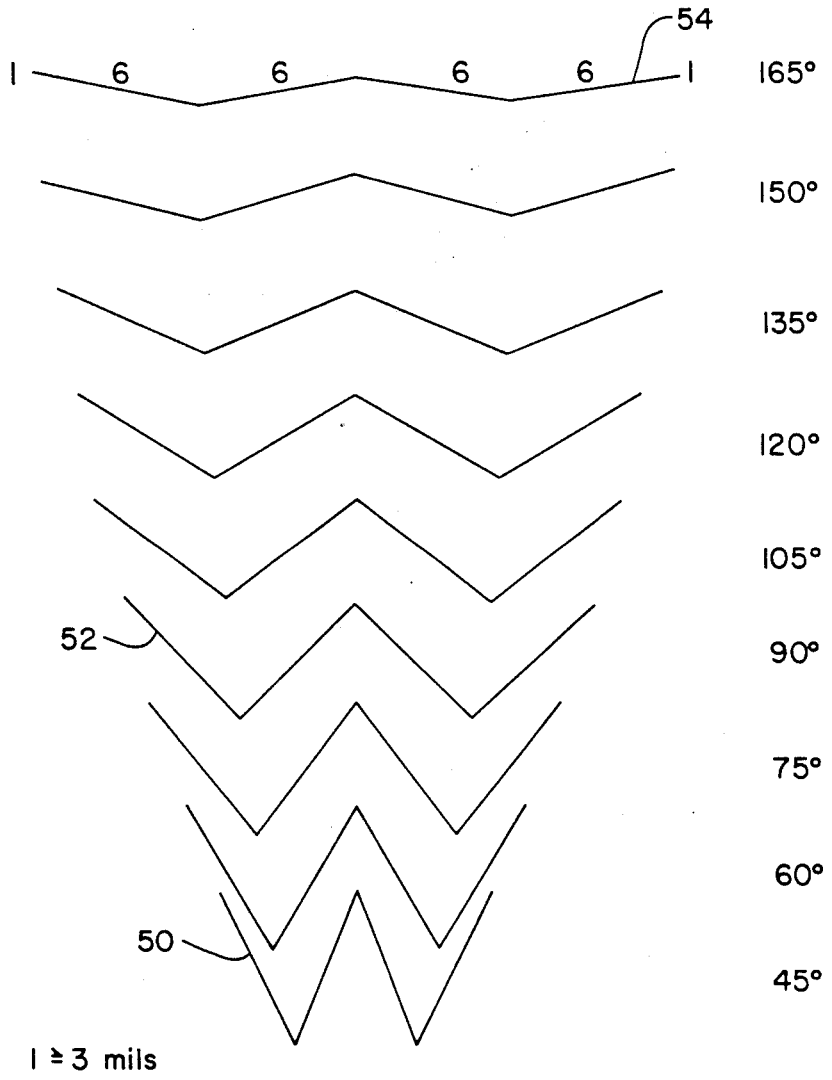
FIG. 6 illustrates a diagrammatic representation of some "W"-shaped spinneret orifices from which fracturable (nonload-bearing) "W"-shaped fibers may be spun.

In FIG. 6 a diagrammatic representation of some "W"-shaped spinneret orifices through which fracturable (nonload-bearing) "W"-shaped fibers may be spun is illustrated. The angle between intersecting segments is shown to the right of each "W"-shaped orifice. For instance, in the discussion above of the use of a 45° "W"-shaped spinneret orifice or a 90° "W"-shaped spinneret orifice, this has reference to the "W"-shaped configurations shown respectively at 50 and 52, where in the first one the angle between intersecting segments is 45° and in the second one is 90°. In the 165° "W"-shaped spinneret orifice 54, the illustrated numbers "1" and "6" represent normalized dimensions, meaning that the width of the "W"-shaped orifice has a normalized dimension of 1, and the length of each segment has a normalized dimension of 6.

In FIG. 7, the modified "W"-shaped spinneret orifice 56 may be used for spinning load-bearing filaments; such spun fiaments will not normally fracture under the conditions normally used for fracturing the nonload-bearing filament components. The modified "W" cross-section is formed from at least four (4) plane FIGS. 58, 60, 62 and 64 joined end to end in the manner shown in FIG. 7. Each of the two outer plane FIGS. 58 and 64 is identical to the other and defines, respectively, four sides identified in FIG. 7 as a, b, c and d. Each of the two intermediate plane FIGS. 60, 62 is identical to the other, is adjacent to one of the outer planes, and defines, respectively, five sides identified in FIG. 7 as e, f, g, h and i. Each side d of an outer plane figure is conjoined and coaligned with side f of an adjacent intermediate plane figure. Each side i of the intermediate plane figure is conjoined and coaligned with side i of the other intermediate plane figure. The interior angle formed between side c of an outer plane figure and side g of an adjacent intermediate plane figure of the modified "W" cross-section of the spinneret orifice is equal to or less than 90°. Each side a of each outer plane figure of the modified "W" cross-section of the spinneret orifice has a normalized dimension of about six (6), each side b of each of the outer plane figures has a normalized dimension of about three (3) and sides d, f and i each have a normalized dimension of about one (1). For example, in FIG. 7 the normalized dimension of one (1) may be equal to 6 mils (0.1524 millimeters) as shown in the drawing; side b may be equal to 3 mils (0.0762 millimeters) and side e may be equal to 36 mils (0.914 millimeters).

In FIG. 8 the spinneret orifice 66 may also be used to produce a compatible load-bearing, nonfracturing fiber component. The spinneret orifice 66 is in the shape of an elongated slot 68 formed from a series of connected parallelograms 70, 72, 74, 76, each being off-set from its adjacent neighbor. The off-set should be such that the width of the slot between and connecting adjacent parallelograms has a normalized dimension of one (1) unit. Sidewall "a", as shown by designation in the drawing, then, should have a normalized dimension ranging from two (2) to four (4) units; and sidewall "b", as also shown by designation in the drawing, then, should have a normalized dimension ranging from one and one half ($1\frac{1}{2}$) units to six (6) units, with respect to the normalized width of the slot.

Each parallelogram has two sets of included, opposed angles. One set may be defined so that each one of the sets has an angle designation of $\alpha$ (alpha). In the other or second set of included, opposed angles, each one has an angle designation of $180° - \alpha$ (alpha). $\alpha$ (alpha) may range from about 90° to about 135°.

Sidewall "a" of each parallelogram is substantially parallel to the minor axis of the elongated slot 68, and sidewall "b" is substantially parallel to the major axis of the elongated slot.

The number of repeated, off-set parallelograms in series may range from three (3) to six (6).

Figure 9:
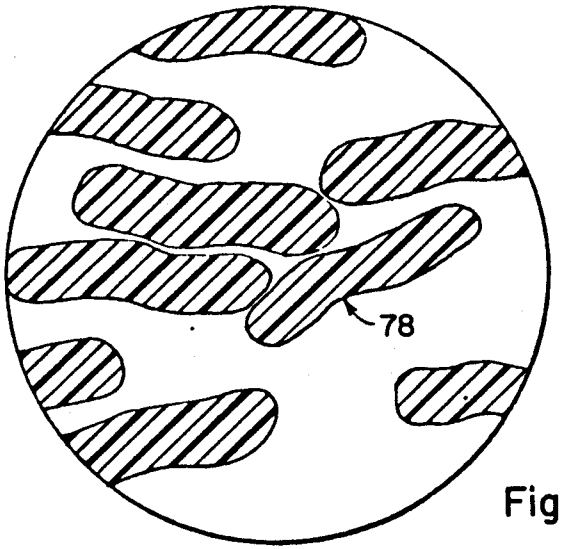
FIG. 9 is a view of a filament cross-section spun through a spinneret orifice similar to that shown in FIG. 8 and illustrates an undulating peripheral surface.

In FIG. 9 some representative polyester fiber cross-sections 78, spun from the spinneret orifice of FIG. 8, are shown as taken from a photograph wherein the fiber cross-sections have been enlarged by magnification. The undulating cross-section of the polyester fiber, such as from polyethylene terephthalate polymer, was obtained by melt extrusion through a spinneret orifice similar to that shown generally in FIG. 8 at 66.

Figure 10:
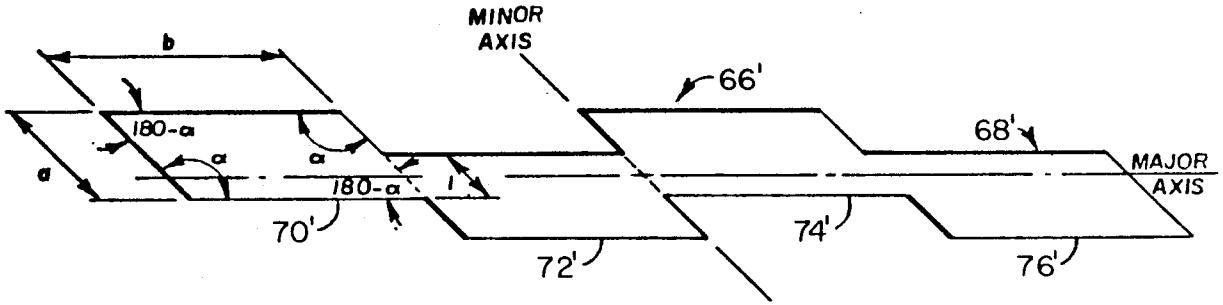
FIG. 10 is a plan view of an alternate embodiment of the spinneret orifice shown in FIG. 8.

FIG. 10 is an alternate embodiment of spinneret orifice 66', with all other reference numbers being identified by the same reference numbers but having prime marks thereafter.

The following are considered to be preferred embodiments of the parallelogram that the spinneret orifice in FIG. 8 may have:

| | |
|---|---|
| 1. | "a" = 2 |
| | "b" = 4 |
| | "$\alpha$ = 90° |
| 2. | "a" = 4 |
| | "b" = 2 |
| | "$\alpha$ = 90° |
| 3. | "a" = 3 |
| | "b" = 3 |
| | "$\alpha$ = 90° |
| 4. | "a" = 4 |
| | "b" = 2 |
| | "$\alpha$ = 135° |

The spinneret orifices of FIGS. 8 and 10 are disclosed in U.S. Pat. No. 4,235,574 (1980).

FIG. 11 discloses another spinneret orifice 80 through which a load-bearing or nonfracturing fiber may be spun. The spinneret orifice is formed from at least seven rectangular linear segments identified respectively as 82, 84, 86, 88, 90, 92, 94. The width of each linear segment has a normalized dimension of one (1) and the length of each linear segment has a normalized dimension of four (4). For example in FIG. 11 the normalized dimension of one (1) may be equal to 6 mils (0.1524 millimeters). Although the dimensions shown in the drawing for linear segments 84 and 92 are 30 mils (0.762 millimeters), these illustrated dimensions include also the width of linear segments 86 and 90. For purposes of this disclosure, however, each "linear segment" per se is actually only 24 mils (0.5996 millimeters) long.

Figure 12:
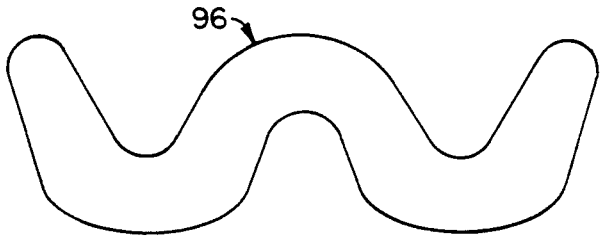
FIG. 12 is a view of a filament cross-section spun through the spinneret orifice shown in FIG. 11.

FIG. 12 illustrates a representative filament cross-section 96 as spun from the spinneret orifice 80.

Figure 13:
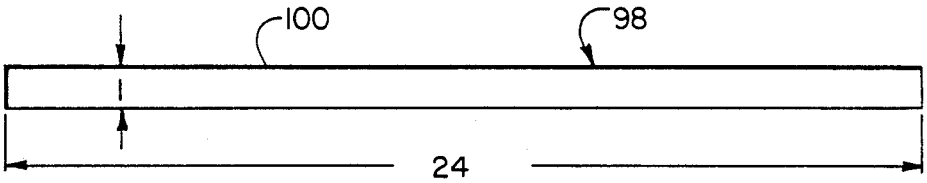
FIG. 13 is another spinneret orifice through which a nonload-bearing or fracturable filament may be spun.

FIG. 13 illustrates another spinneret orifice 98 through which a nonload-bearing or fracturing filament may be spun. The spinneret orifice is formed from a rectangular linear segment or bar 100. The width of this linear segment or bar has a normalized dimension of one (1) and the length of this linear segment or bar has a normalized dimension of twenty-four (24). For example in FIG. 13 the width may have a normalized dimension of one (1) which may be equal to 6 mils (0.1524 millimeters) while the length may have a normalized dimension of 144 mils (3.6576 millimeters).

Figure 14:
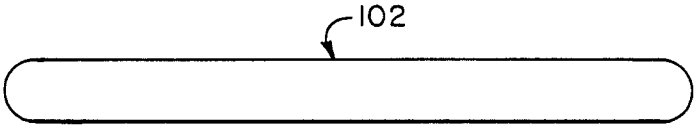
FIG. 14 is an approximate view of a filament ribbon cross-section that would be spun from the spinneret orifice of FIG. 13.

FIG. 14 illustrates diagrammatically the filament cross-section 102 that would be spun from the spinneret orifice shown in FIG. 13.

FIG. 15 is a diagrammatic view of a 165° "W" filament cross-section illustrating most likely fracturing locations. For instance, the (1) locations represent most likely fracture initiation locations with the (2) location being less likely.

FIG. 16 is a diagrammatic view of a 180° slot filament cross-section which shows that the most likely fracture initiation location (1) occurs in the middle.

Figure 17:
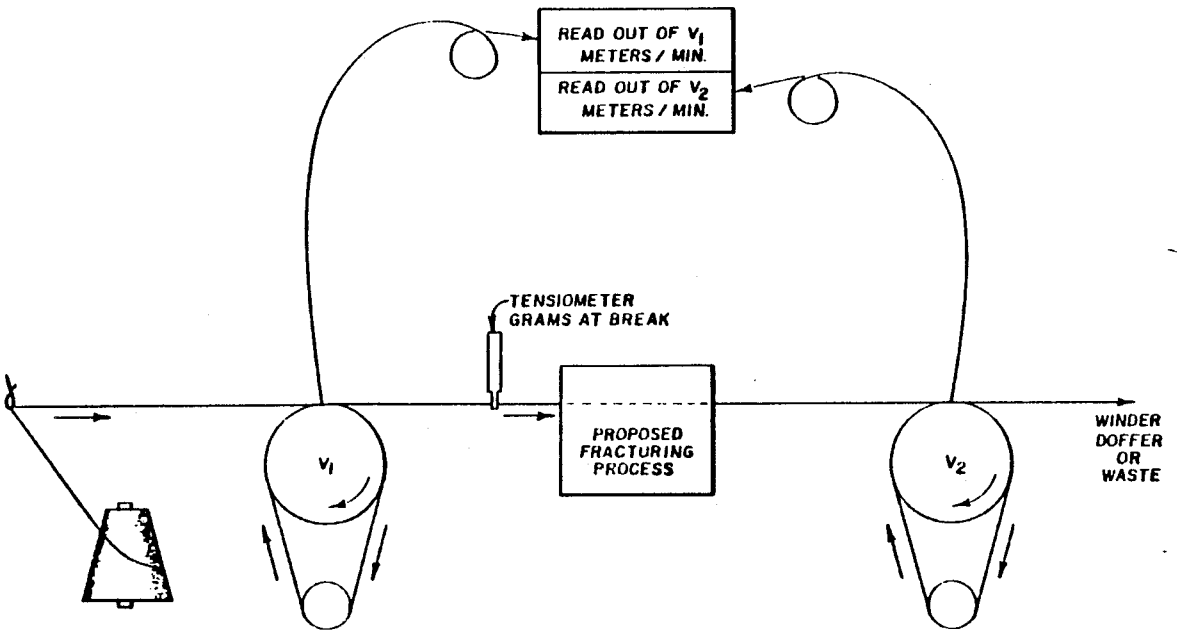
FIG. 17 is a sketch showing the equipment used to determine Bp* (brittleness parameter) of yarn to be fractured.

As indicated and referred to earlier, FIG. 17, is a sketch showing the equipment used to determine Bp* (brittleness parameter) of yarn to be fractured.

Individual Photomicrographs

FIGS. 18 through 52 are a number of individual photomicrographs taken at various magnifications, the magnification being indicated beneath the photomicrograph, of portions of differently fractured yarns. These yarns were withdrawn from several different yarn packages and then randomly selected small portions were cut and placed under an electron microscope and photographed. Certain characteristics were noted to repeat themselves in the photomicrographs and thus were considered to be the dominant features of these yarns. It should be understood, however, that each yarn sample, as represented by the individual photomicrographs, does not necessarily show all of these dominant features. The features or characteristics revealed at one selected magnification on one side of the yarn may or may not, or may in part, be revealed on the opposite side of the yarn sample at the same location if it were rotated under the electron microscope. There are various loop constructions that are also typical of the yarns of this invention such as arch loops, crunodal loops and partial loops.

Figure 23:
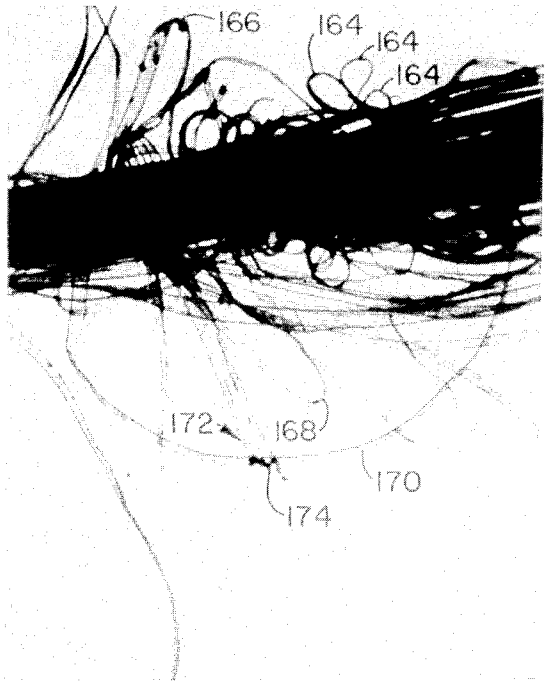

FIGS. 18 through 24 are photomicrographs, for instance, of yarn of the present invention wherein the lighting for the magnification was selected to cause the yarn bundle to show up in dark silhouette form. All of these photomicrographs, except FIG. 23, were taken at 44 magnification, while FIG. 23 was taken at 56 magnification; and each, except FIG. 23, is of a yarn sample wherein the load-bearing non-fracturing filament was spun through a spinneret orifice of the type shown in FIG. 8, while the nonload-bearing fractured filament was spun through a 165° "W" cross-section spinneret orifice as represented by the one shown in FIG. 6.

Figure 18:
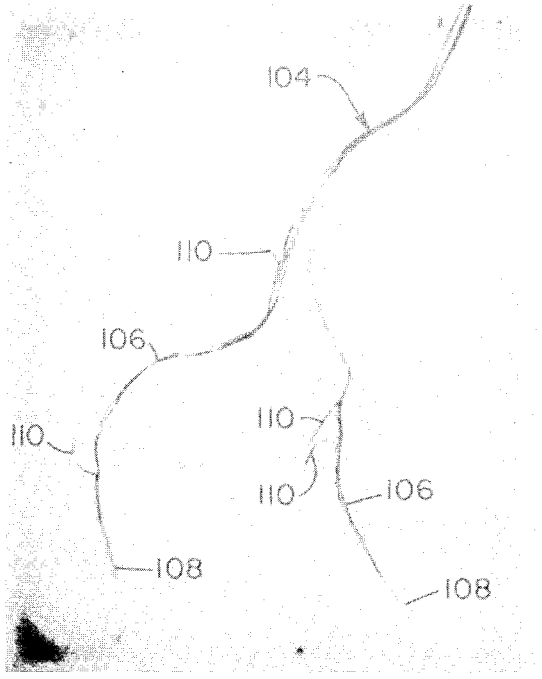

FIG. 18 shows a nonload-bearing filament 104 that has been fractured and freely protrudes from the yarn bundle (not shown). The fractured filament has branch-like ends 106 with the ends being tapered as shown at 108, and several barbs 110.

Figure 19:
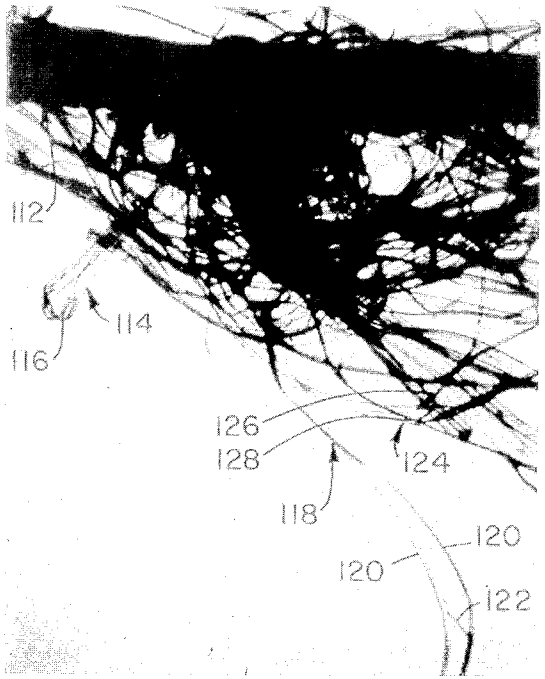
FIGS. 18 through 52 are photomicrographs illustrating magnified portions of various yarn constructions to show commonly occurring characteristics.

FIG. 19 shows a mass of entanglements around the yarn bundle 112, and at least one projecting loop 114 in which close inspection reveals at least one discontinuous slit 116. There is at least one discernible nonload-bearing protruding filament end 118 that has fractured into two ends 120, and at least one barb 122. Another nonload-bearing filament 124 has fractured or split once in the center of its width and then split again into at least two discernible protruding ends 126, 128.

Figure 20:
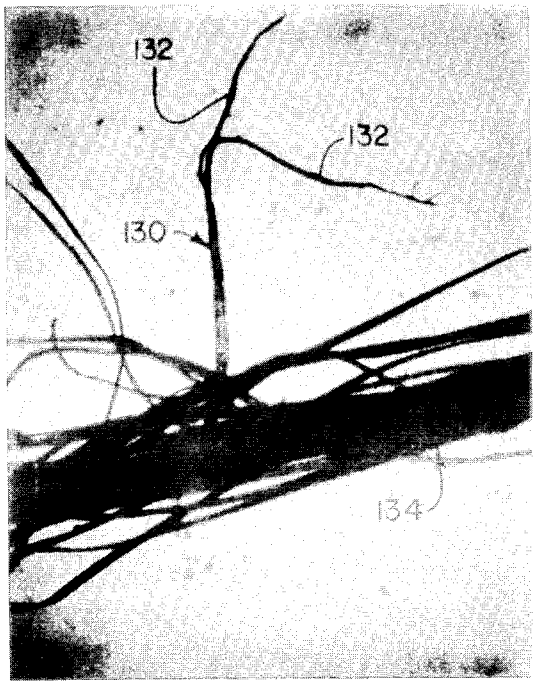

FIG. 20 shows at least one complete free protruding nonload-bearing filament end 130 having branch-like ends 132, the filament end projecting from the yarn bundle 134.

Figure 21:
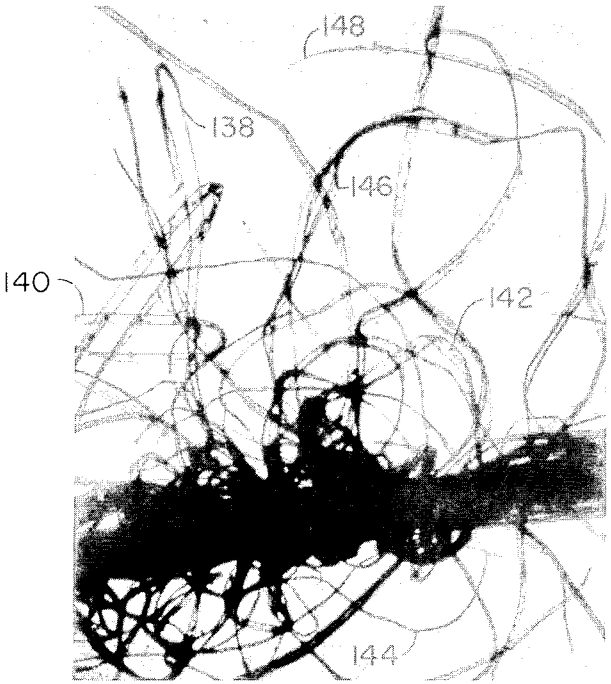

FIG. 21 shows a yarn bundle 136 having a number of entanglements; projecting loop 138, 140; angled bends 142, where the nonload-bearing filament has folded across itself and has taken a different direction from which it initially projected; arch loops such as the one shown at 144; multiple splits 146: and at least one tapered end 148 formed on one of the free protruding filaments.

Figure 22:
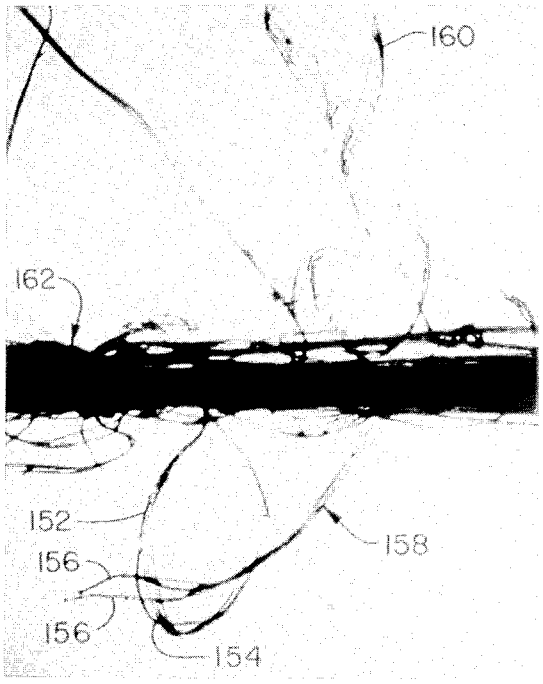

FIG. 22 shows a yarn bundle 150, a projecting loop 152 in the form of a crunodal loop, which in turn also has a discontinuous slit 154; branch-like ends 156 on the end of a free protruding filament 158; and at least another projecting loop 160.

FIG. 23 shows a yarn bundle 162 having small multiple loops 164 spaced close to each other; other projecting loops at 166, 168; an arch loop 170; and at least one nonload-bearing filament 172 that is transversely broken across the width of the filament cross-section to form filament free ends as shown at 174.

Figure 24:
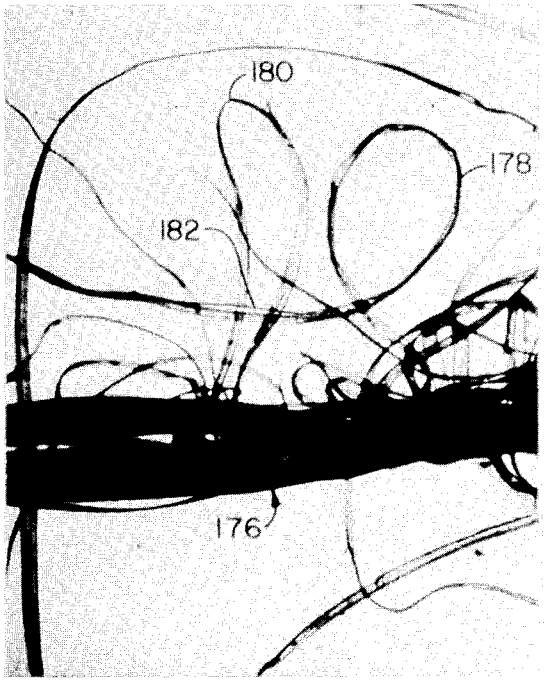

FIG. 24 shows a yarn bundle 176 that has at least one crunodal loop 178, a projecting loop 180; and at least one discontinuous split 182.

FIGS. 25 through 29 show yarn bodies having 165° "W" cross-section nonload-bearing fractured filaments and 45° "W" cross-section load-bearing filaments. The lighting for the magnification was such as to show clear details of the yarn bundle.

Figure 25:
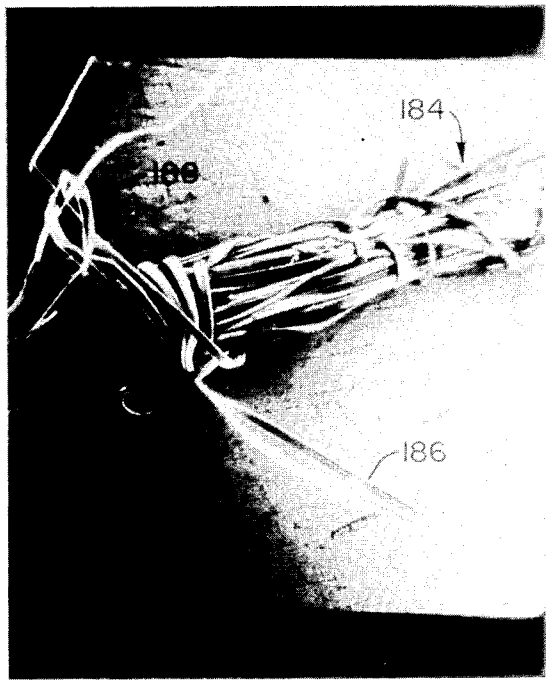

FIG. 25 shows a yarn bundle 184 having a number of entanglements, projecting loops 186, 188 and at least one discernible barb 190.

Figure 26:
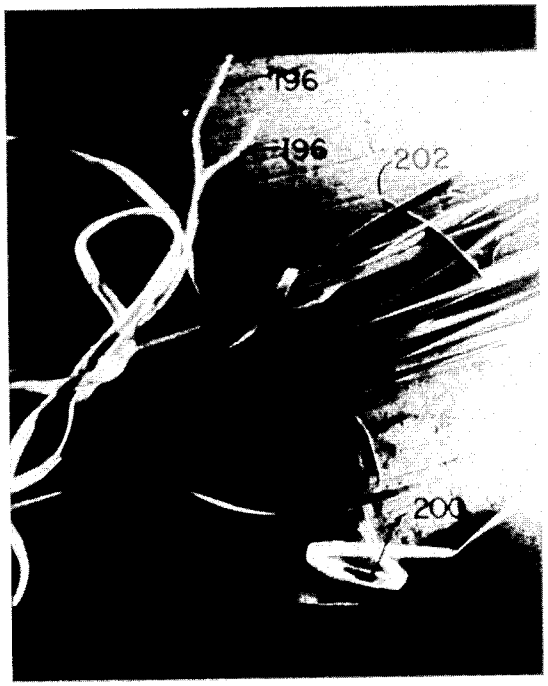

FIG. 26 shows a yarn bundle 192 from which there is shown at least one free protruding filament end 194 having branch-like ends 196; projecting loops 198, 200; and another protruding filament end 202.

Figure 27:
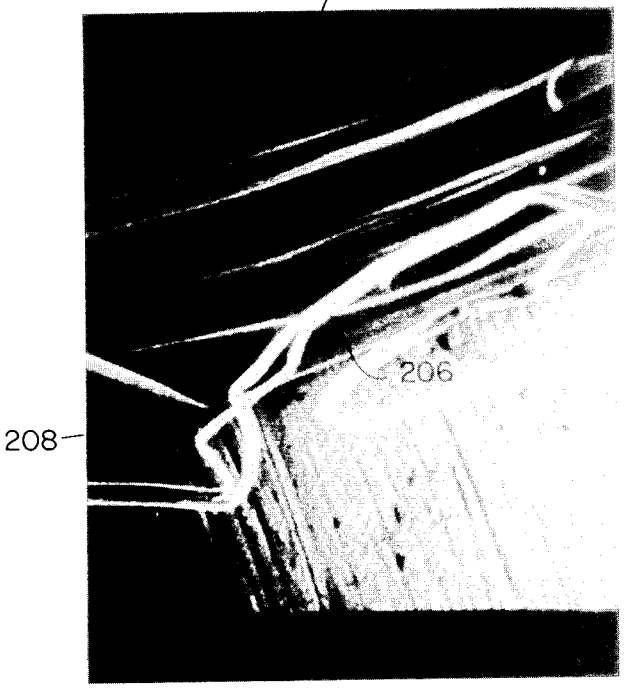

FIG. 27 shows the yarn bundle at 204, a free protruding filament 206 and at least one discontinuous slit 208 in the free protruding filament 206.

Figure 28:
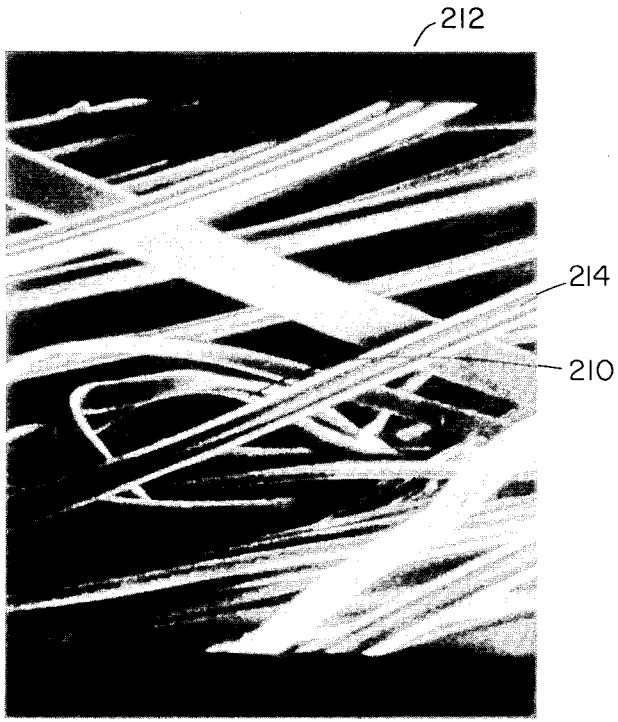

FIG. 28 reveals among the mass of filaments shown at least one filament having a discontinuous slit at 210. Note also the ridges in the "W" cross-section filaments as shown by filaments 212 and 214.

Figure 29:
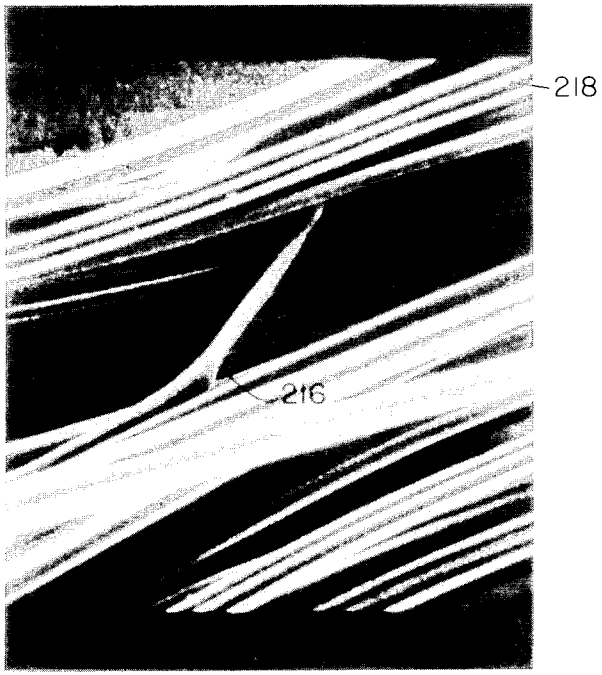

FIG. 29 shows a split in a filament at 216. Also the cross-sections of the adjacent filaments reveal the ridge-like structure of the "W" cross-section filaments, as shown for instance at 218.

FIGS. 30–31

Figure 31:
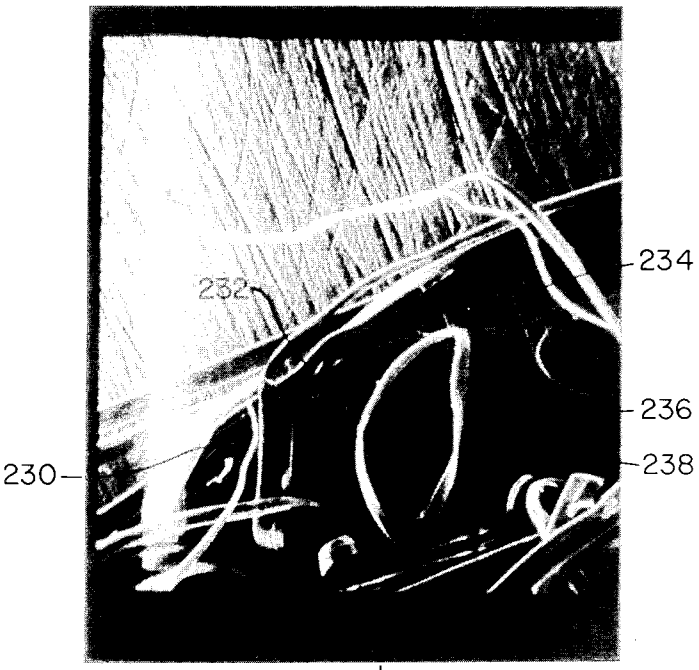
Figure 30:
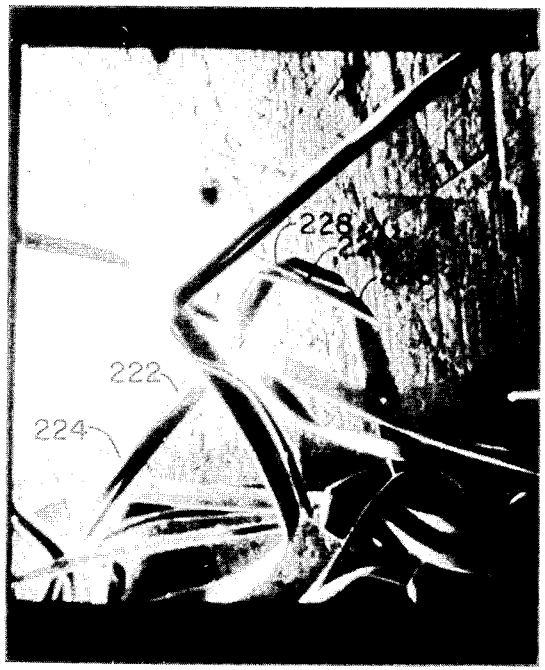

FIGS. 30 and 31 show yarn bodies where the nonload-bearing filaments are extruded from a 180° spinneret orifice such as shown in FIG. 13.

FIG. 30 shows a number of multiple discontinuous slits in the nonload-bearing filaments as shown at 220, 222, 224; and angled bends at 226, 228.

FIG. 31 shows nonload-bearing filaments which have multiple splits, as shown at 230, 232; discontinuous slits as shown at 234; at least one projecting loop 236; at least one free protruding filament which is transversely broken across, as shown at 238; and a projecting loop 240 which has a discontinuous slit therein.

FIGS. 32–44

FIGS. 32 through 44 are other examples of a still different yarn sample but also having nonload-bearing filaments spun through a 165° spinneret orifice such as shown in FIG. 6.

Figure 33:
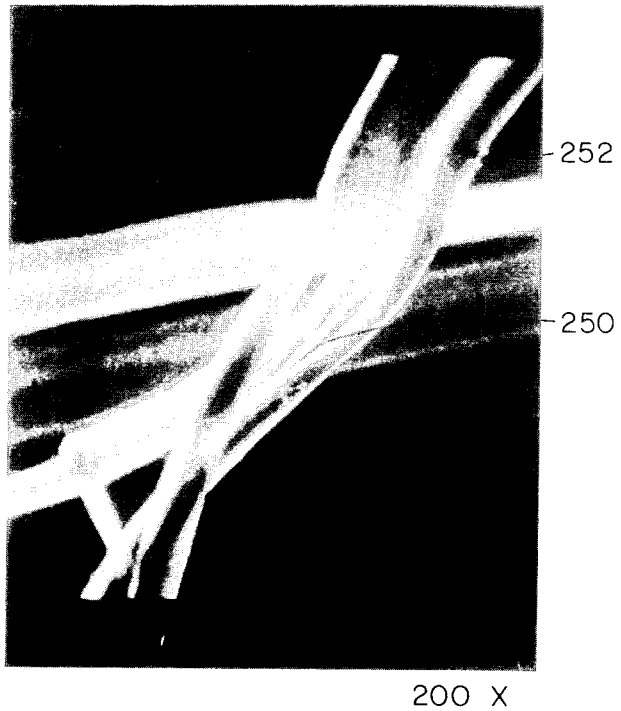
Figure 32:
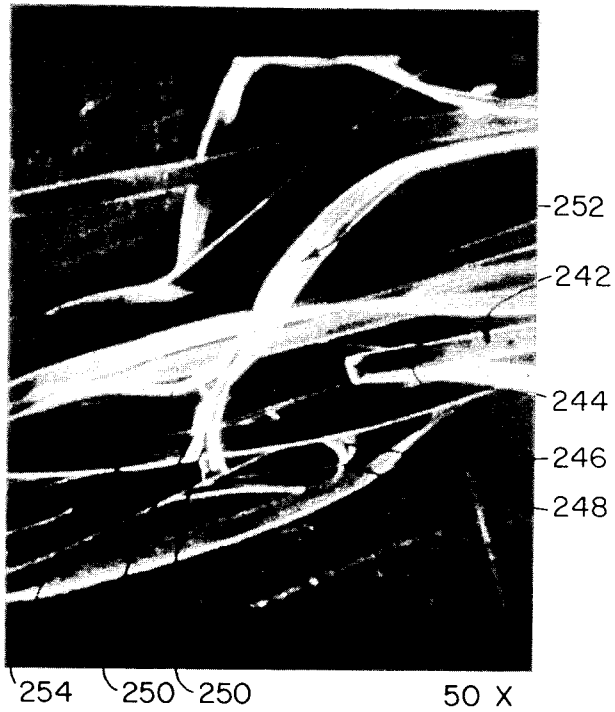

FIGS. 32 and 33 are successive magnifications taken at the same position along the yarn, respectively, at 50 and 200 magnifications. In FIG. 32, filament 242 has an angled bend 244 formed therein; a discontinuous slit 246 is shown formed in the loop end of filament 248; a multiple split 250 is formed in filament 252, which in turn terminates in branch-like ends 254. In FIG. 33 a further enlarged view is given of the yarn shown in FIG. 32 to show the multiple split 250 in better detail. Note also the rib-like configuration of the 165° "W" cross-section shown by filament 250.

Figure 35:
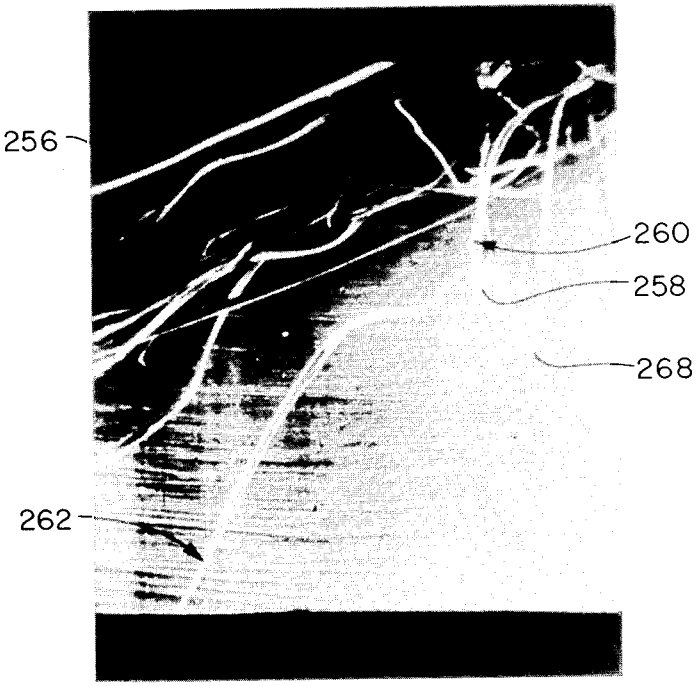
Figure 34:
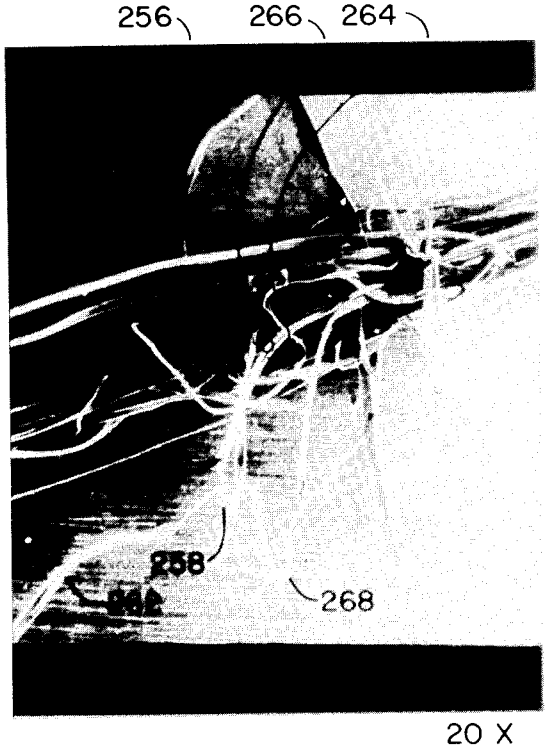
Figure 36:
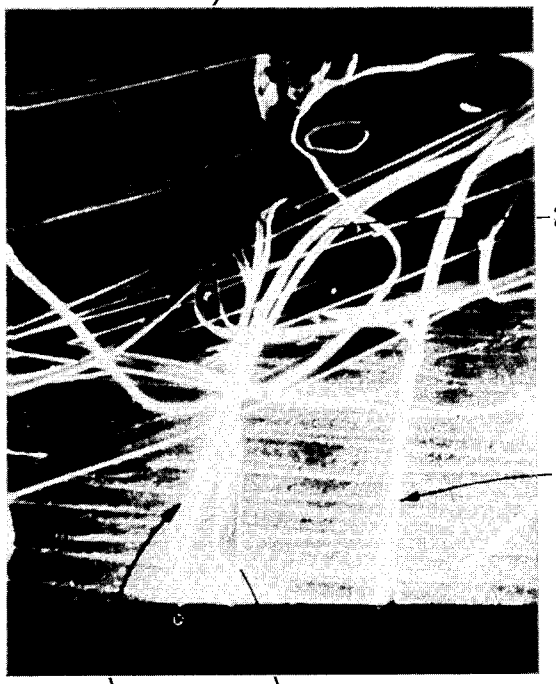

FIGS. 34–36 are views taken of the same yarn bundle 256 but either made at the same magnification and shifted slightly along the length of the yarn bundle, as shown in FIG. 35, or taken at the same location and at a greater magnification (50 power), as shown in FIG. 36. In FIG. 34, a projecting loop 258 is formed in one filament 260, and another filament 262 has threaded through the projecting loop 258. Filament 260 has at least two discernible discontinuous slits 264, 266 at a location just emerging from the yarn bundle. Filament 262 in turn also is formed into a projecting loop 268. Other loops are shown in FIG. 34 but will not be especially otherwise noted.

Figure 37:
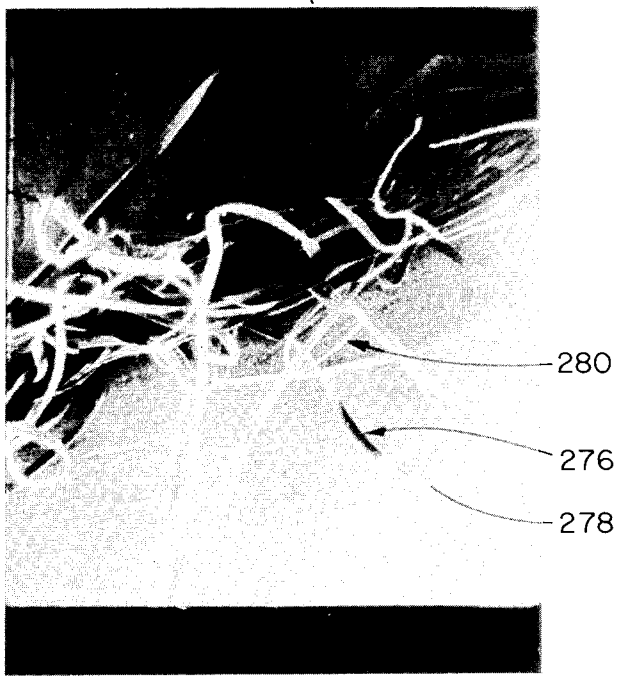
Figure 39:
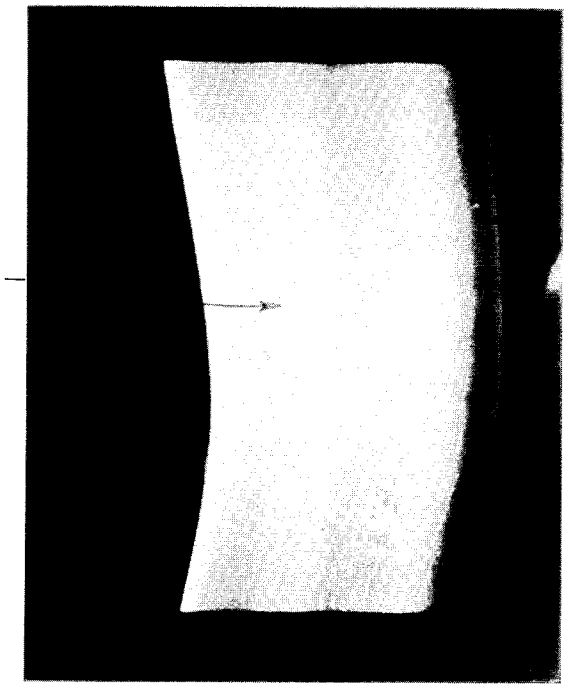
Figure 38:
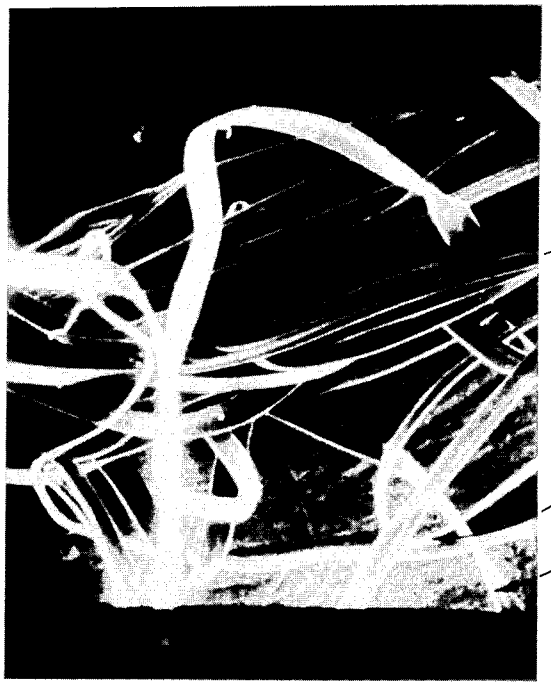

FIGS. 37–39 are taken, respectively, at 20, 50 and 500 magnifications at the same location along the yarn bundle 270. In FIG. 37, a discontinuous slit 272 is shown in the projecting loop 274. Filament 276 has a free protruding end 278, the filament itself having threaded through another projecting loop 280. In FIG. 38, at least one discontinuous slit is shown at 282. In FIG. 39, a closeup of one of the 165° "W" cross-section filaments 284 is shown illustrating ridge-like configurations of the 165° "W" cross-section.

Figure 41:
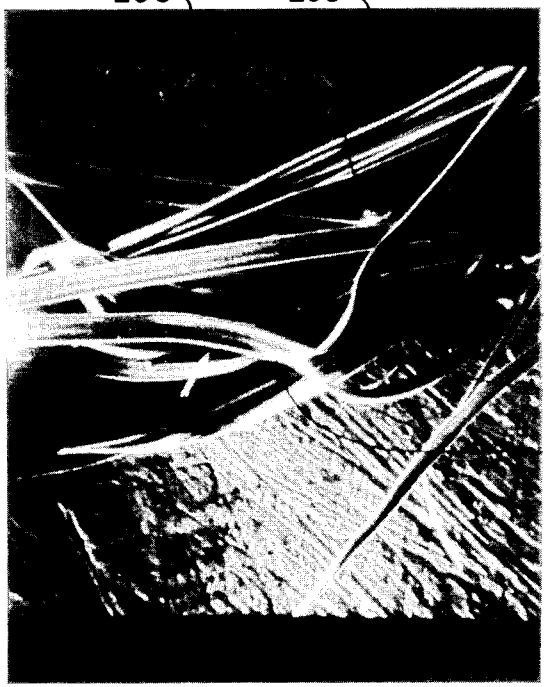
Figure 40:
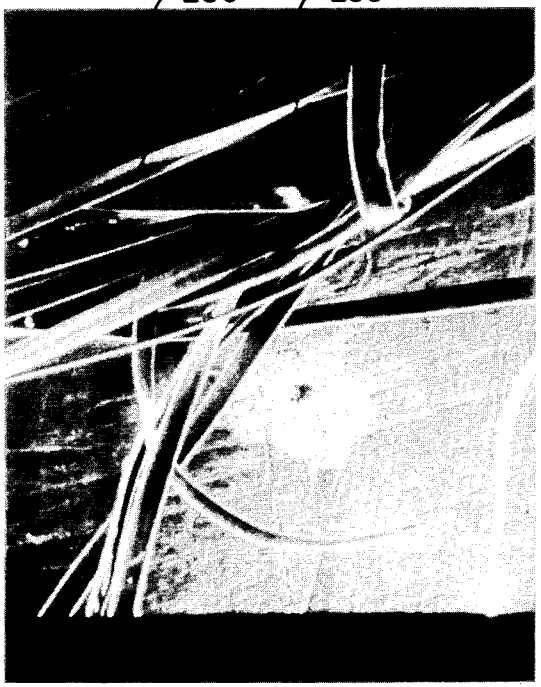
Figure 42:
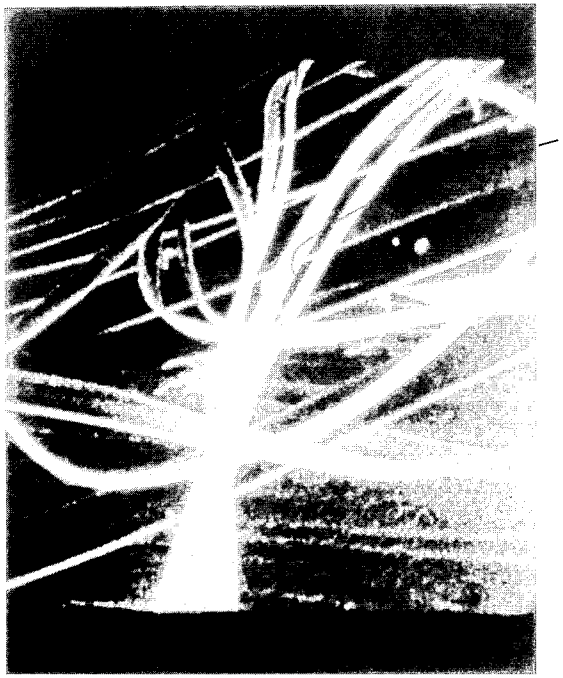

FIGS. 40–44 are a series of photomicrographs taken of other examples of 165° "W" cross-sections taken, respectively, at magnifications of 50, 50, 100, 20 and 20. In FIG. 40, note the locations across the width of the filaments of discontinuous slits 286 and 288 which occurred away from the center. In FIG. 41, the filament 290 appears to have split at the middle of the width, as compared to the splitting shown in FIG. 40, and filament 292 has a short discontinuous slit 294 that also has occurred at the middle of the width of the filament. Note further filament 196 which shows a split 298 occurring at the middle of the width. FIG. 42 shows splits occurring at 300 and 302.

Figure 43:
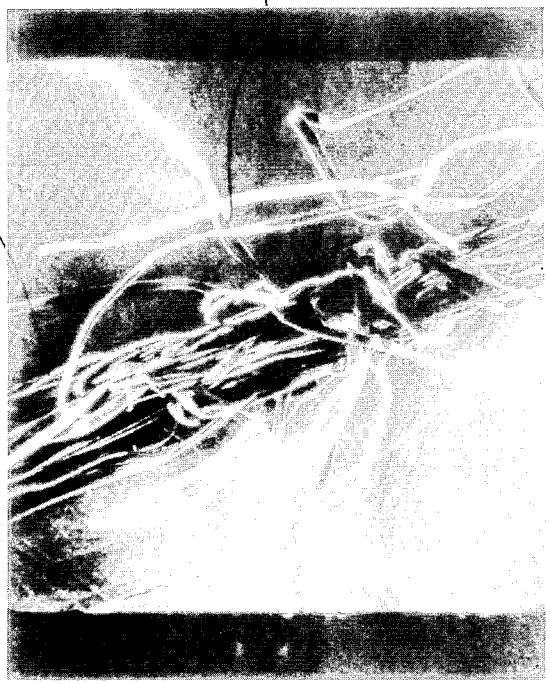
Figure 44:
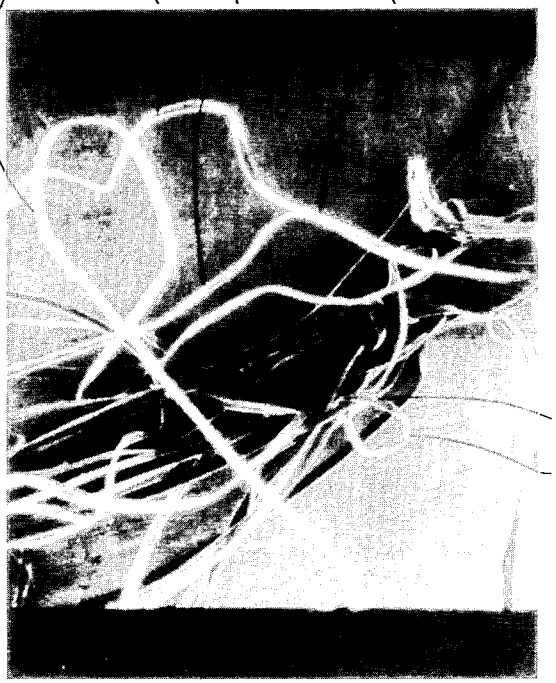

FIG. 43 shows a yarn bundle 304 having a number of entanglements, projecting loops and at least one discontinuous slit 306. FIG. 44 shows a projecting loop 308; a free protruding filament end 310 extending through the loop 308; and another projecting loop 312 having a discontinuous slit 314 formed therein. The free protruding filament end 310 in turn has split away from the main continuous filament 316 with the other leg 318 of the split extending off to the left in the photomicrograph.

FIGS. 45–52

FIGS. 45 through 52 are photomicrographs of still other nonload-bearing 165° "W" cross-section fractured filaments, and nonfractured load-bearing filaments spun through a spinneret orifice similar to that shown in FIG. 8.

Figure 45:
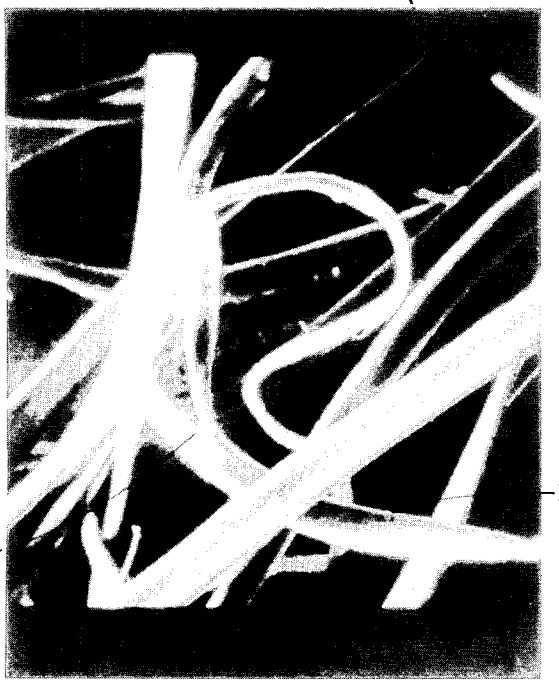

FIG. 45 was taken at 200 magnification. Filament 320 is shown split at 322 with one leg trailing off into a loop 324 and the other leg going in a different direction.

Figure 47:
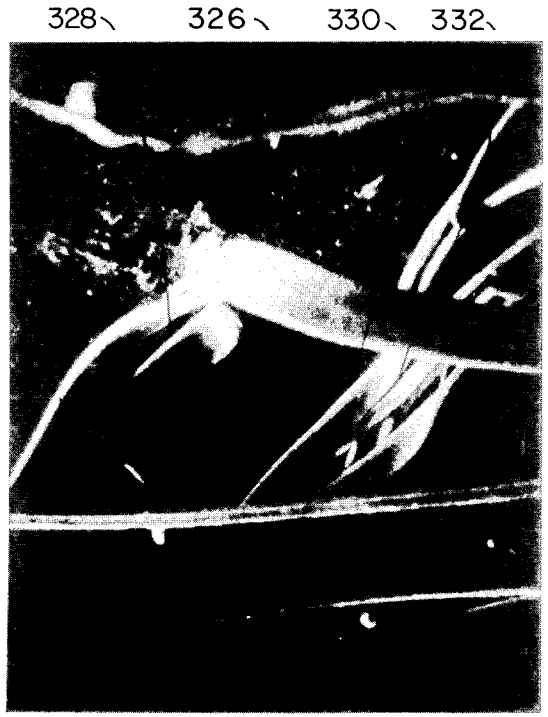
Figure 46:
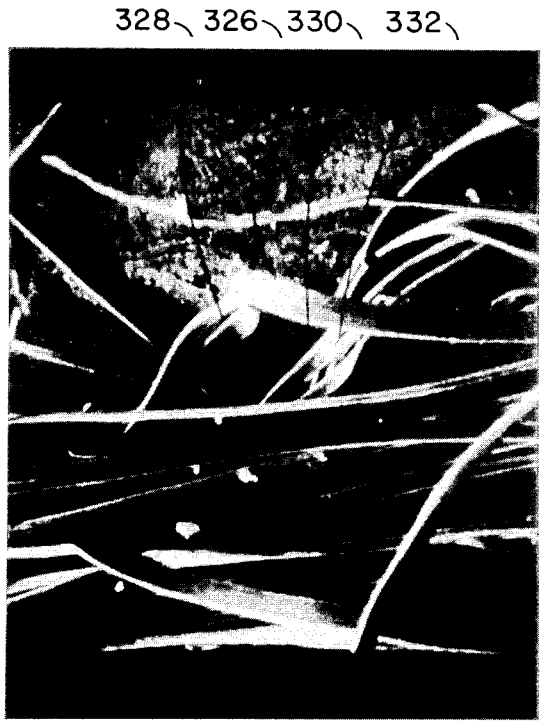

FIGS. 46 and 47 were taken at the same location at magnifications of 100 and 200 respectively. Filament 326 has a multiple split at 328, and filament 330 has a split at 332.

Figure 49:
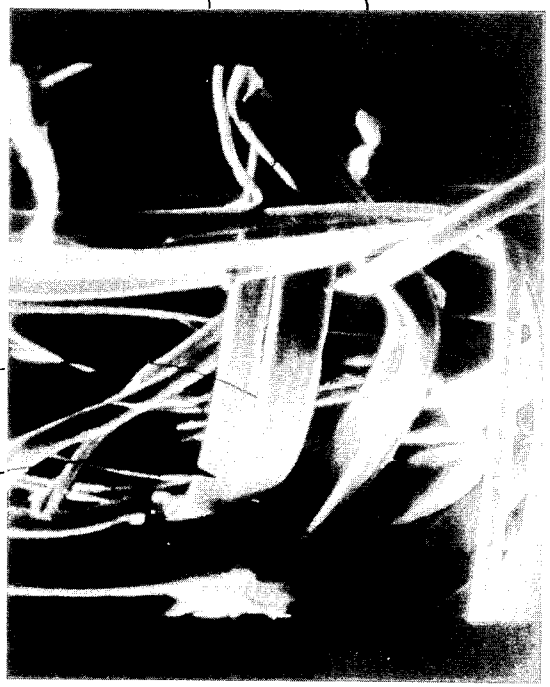
Figure 48:
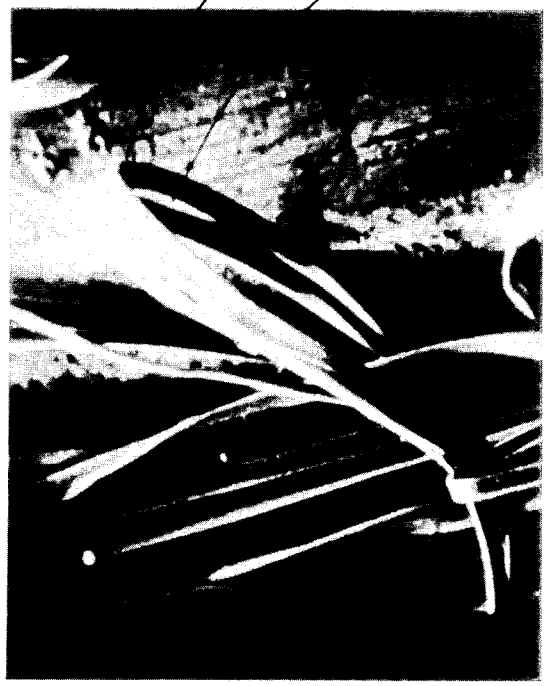

FIG. 48, taken at 100 magnification, shows a projecting loop 334 having a discontinuous slit 336 therein. FIG. 49 taken at 200 magnification shows a filament 338 having a split 340 therein, and filament 342 is split at 344.

Figure 51:
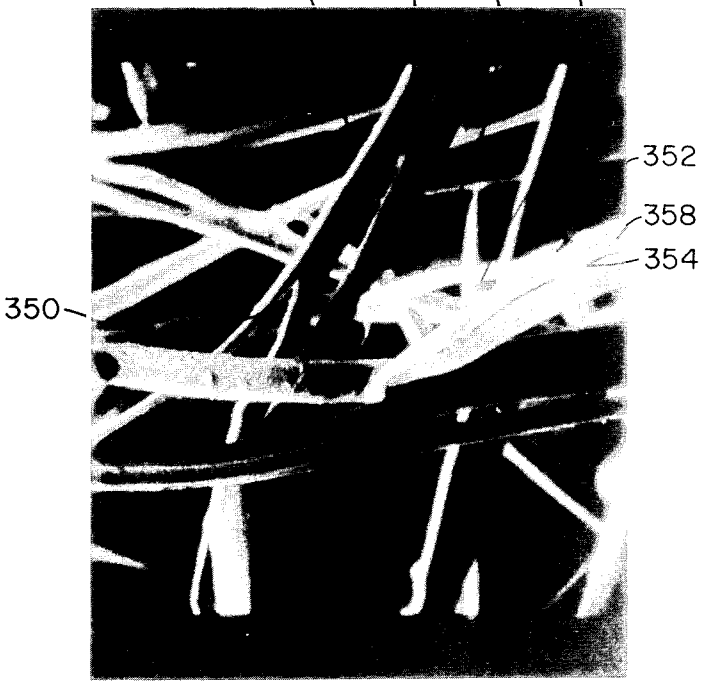
Figure 50:
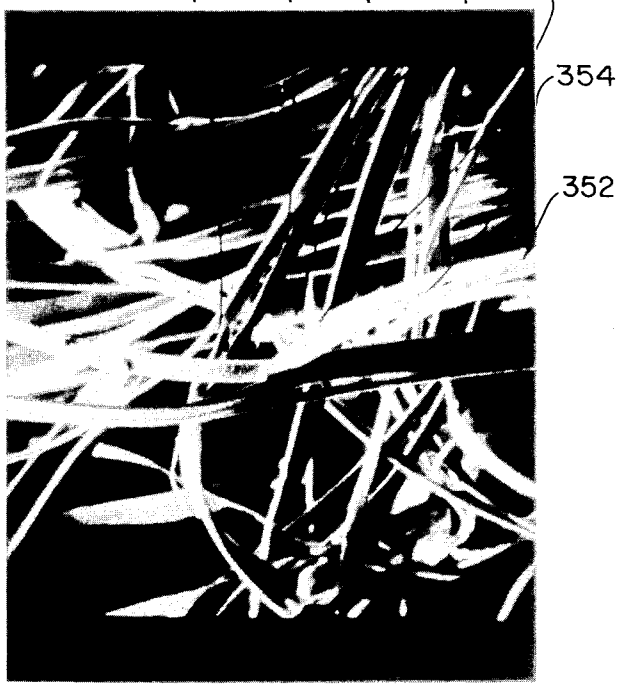

FIGS. 50–51 are taken at the same yarn bundle location but at successive magnifications of 100 and 200, respectively. Filament 346 has multiple splits 348, 350 while an adjacent filament 352 has a discontinuous slit 354 and another split at 356 which resulted in a short free protruding filament end 358.

Figure 52:
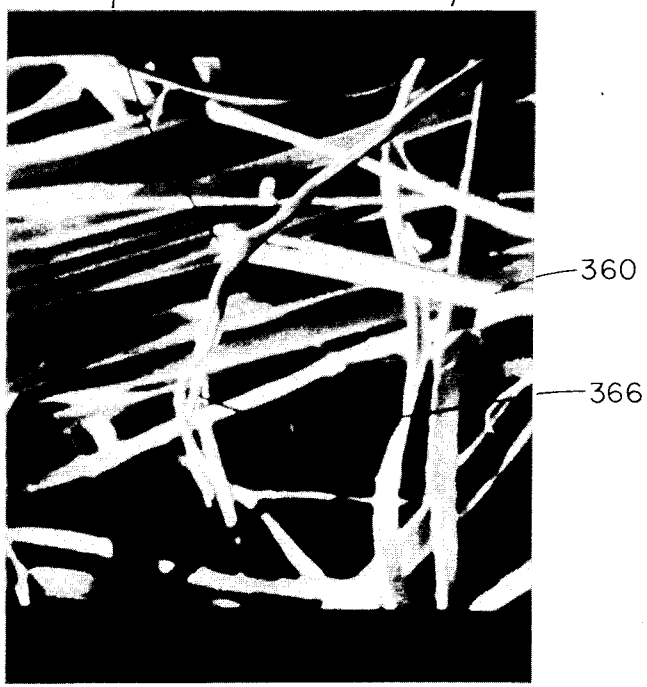

FIG. 52 taken at 100 magnification shows a free protruding filament end 360 that is split and then transversely broken across its free end at 362, and another filament 364 that has split multiply into three parts at 366.

The invention has been described in detail with particular reference to preferred embodiments thereof, but it will be understood that variations and modifications can be effected within the spirit and scope of the invention.

We claim:

1. Continuous filament yarn comprising a bundle of nonload-bearing fracturable filaments and load-bearing nonfracturable filaments, each filament of said nonload-bearing fracturable filaments comprising a ribbon cross-section having at least an 8:1·L/D ratio, and each filament of said load-bearing nonfracturable filaments comprising an undulating cross-section, said yarn having an elongation to break of equal to or less than 180% and wherein the percentage difference between the elongation to break of the nonload-bearing fracturable filaments versus the load-bearing nonfracturable filaments differs by no more than 30% based on the elongation-to-break of the load-bearing nonfracturable filaments, and said nonload-bearing fracturable filaments and said load-bearing nonfracturable filament also being further characterized by dyeing compatibility to the extent that by visual inspection there is no discernible difference in color between the nonload-bearing fracturable filaments and the load-bearing nonfracturable filaments.

2. Continuous filament yarn as defined in claim 1 wherein said yarn has an elongation-to-break $\leqq 50\%$ and is thermally stabilized to a boiling water shrinkage $\leqq 15\%$.

3. Continuous filament yarn as defined in claim 1 wherein the percentage of nonload-bearing fracturable filaments to load-bearing nonfracturable filaments in said yarn varies about 20% to about 80%.

4. Continuous filament yarn as defined in claim 1 wherein said yarn is partially oriented yarn.

5. Continuous filament yarn as defined in claim 1 wherein said yarn is fully oriented yarn.

6. Fractured continuous filament yarn having the characteristics defined in claim 1 and having spun-like or staple-like character, wherein said nonload-bearing filaments at random intervals along their lengths (a) in part define discontinuous slits of varied lengths;

(b) in part are transversely broken across the width of the filament cross-sections to form filament-free ends;

(c) in part are transversely broken partly across the width of the filament cross-sections and split away from the main body of each such filament to form partial filament-free ends; and (d) in part are split and broken at randomly staggered intervals across the width of the filament cross-sections to form branch-like ends;

said separate free ends, said partial filament-free ends and said branch-like ends collectively forming a multitude of free protruding ends extending from said bundle; and said load-bearing filaments being essentially unbroken in relation to said nonload-bearing filaments.

7. Fractured continuous filament yarn as defined in claim 6 wherein said yarn has an elongation-to-break $\leqq 50\%$ and is thermally stabilized to a boiling water shrinkage $\leqq 15\%$, and said nonload-bearing fractured filaments and load-bearing nonfractured filaments are each compatible with the other in dyeing characteristics to the extent that by visual inspection there is no discernible difference in color between the nonload-bearing fractured filaments and the load-bearing nonfractured filaments.

8. Fractured continuous filament yarn as defined in claim 6 wherein said separate free ends, said partial free ends and said branch-like ends have lineal portions that are randomly formed into crunodal loops, arch loops and partial loops between said ends and said bundle.

9. Fractured continuous filament yarn as defined in claim 6 wherein each of said nonload-bearing filaments has a ribbon cross-section and said separate free ends, said partial free ends and said branch-like ends are randomly formed variously into angled bends, projecting loops, crunodal loops and arch loops between said ends and said bundle.

10. Fractured continuous filament yarn as defined in claim 6 wherein the percentage of load-bearing filaments to nonload-bearing filaments in said yarn varies from about 20% to about 80%.

11. Fractured continuous filament yarn as defined in claim 6 wherein said load-bearing filament has an undulating oblong cross-section.

12. Fractured continuous filament yarn as defined in claim 6 wherein said nonload-bearing filament has a ribbon cross-section having at least an 8:1 L/D ratio.

13. Fractured continuous filament yarn as defined in claim 6 wherein said yarn has a tenacity of at least 1.50 grams per denier, an elongation of about 15% to about 30%, a modulus of about 30 to about 60 grams per denier, a boiling water shrinkage of about 1% to about 8%, and a specific volume at 0.1 grams per denier tension of at least 1.5 cubic centimeters per gram.

14. Fractured continuous filament yarn as defined in claim 6 wherein said nonload-bearing filaments each has a cross-section of two or more unbranched linear segments joined end to end.

15. Fractured continuous filament yarn as defined in claim 12 wherein the initiation location for a fracture occurs approximately at the middle of the width of said ribbon cross-section.

16. Fractured continuous filament yarn as defined in claim 14 wherein the initiation location for a fracture occurs approximately at the outermost intersection of said unbranched segments across the width of said unbranched linear segments.

17. Process for fracturing a continuous filament textile yarn comprising a bundle of nonload-bearing fracturable filaments and load-bearing non-fracturable filaments, said yarn having an elongation-to-break of equal to or less than 180%, and wherein the percentage difference between the elongation-to-break of the nonload-bearing fracturable filaments versus the load-bearing nonfracturable filaments differs by no more than 30% based on the elongation-to-break of the load-bearing nonfracturable filaments, said load-bearing filaments having a brittleness parameter $>0.80$, said process comprising:

fracturing the nonload-bearing filament portion of said yarn utilizing a fluid fracturing jet operating at a brittleness parameter of about 0.03 to 0.5 for the yarn being fractured, the difference between the brittleness parameter for the fracturable filaments and the brittleness parameter for the nonfracturable filaments being $\geqq 0.3$ units.

18. Process of claim 17 wherein said yarn is a poly(ethylene terephthalate) yarn.

19. Process of claim 17 wherein said fluid fracturing jet is operated at a brittleness parameter (Bp*) of about 0.03 to about 0.4.

20. Process of claim 17 wherein the specific volume of the fractured yarn is made to vary along the yarn strand by varying the fracturing jet air pressure.

21. Continuous filament yarn according to claim 1 wherein the ribbon cross-section of said nonload-bearing fracturable filaments has two or more unbranched linear segments joined end to end.

* * * * *